US008381818B2

(12) United States Patent
Adams et al.

(10) Patent No.: US 8,381,818 B2
(45) **Date of Patent: *Feb. 26, 2013**

(54) APPARATUS FOR, AND METHOD OF, LANDING ITEMS AT A WELL LOCATION

(75) Inventors: Burt A. Adams, Berwick, LA (US); Norman A. Henry, Mandeville, LA (US)

(73) Assignee: Archer Rental Services, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/026,795

(22) Filed: Feb. 14, 2011

(65) Prior Publication Data

US 2011/0209877 A1 Sep. 1, 2011

Related U.S. Application Data

(63) Continuation of application No. 11/927,847, filed on Oct. 30, 2007, now Pat. No. 7,886,827, which is a continuation of application No. 11/402,302, filed on Apr. 10, 2006, now Pat. No. 7,287,598, which is a continuation-in-part of application No. 10/640,496, (Continued)

(51) Int. Cl.
*E21B 19/18* (2006.01)
*E21B 29/12* (2006.01)

(52) U.S. Cl. ..... 166/338; 166/348; 166/382; 166/381; 166/77.53; 175/203

(58) Field of Classification Search ..... 166/382, 166/367, 379, 380, 77.1, 77.51, 77.52, 77.53, 166/77.14, 85.1; 175/5, 7, 24, 202, 203
See application file for complete search history.

(56) References Cited

U.S. PATENT DOCUMENTS 3,094,852 A 6/1963 Taylor (Continued)

FOREIGN PATENT DOCUMENTS

WO WO 00/52297 9/2000
WO WO 01/94737 12/2001

(Continued)

OTHER PUBLICATIONS

S.T. Horton, "Drill String and Drill Collars," Rotary Drilling Series of Instructional Texts, Unit I, Lesson 3, First Edition, 1995 (more than 4 years earlier than effective filing date of captioneid application), pp. 0-105 (entire book) published by Petroleum Extension Service, Division of Continuing Education, The University of Texas at Austin, in cooperation with International Association of Drilling Contractors.

(Continued)

*Primary Examiner* — Thomas Beach
*Assistant Examiner* — James Sayre
(74) *Attorney, Agent, or Firm* — Garvey, Smith, Nehrbass & North, L.L.C.; Brett A. North

(57) ABSTRACT

An apparatus for, and method of, lowering items from a drilling rig to a well located below it through the use of a landing string comprised of drill pipe having an enlarged diameter section with a shoulder, in combination with upper and lower holders having wedge members with shoulders that engage and support the drill pipe at the shoulder of the enlarged diameter section, the shoulder of the drill pipe and the shoulders of the wedge members being rotatable with respect to each other.

18 Claims, 27 Drawing Sheets

Related U.S. Application Data filed on Aug. 13, 2003, now Pat. No. 7,025,147, which is a continuation-in-part of application No. 10/055,005, filed on Jan. 23, 2002, now Pat. No. 6,644,413, which is a continuation-in-part of application No. 09/586,239, filed on Jun. 2, 2000, now Pat. No. 6,378,614.

(56) References Cited

U.S. PATENT DOCUMENTS

| | | | | | |
|---|---|---|---|---|---|
| 3,096,075 | A | | 7/1963 | Brown | |
| 3,629,927 | A | | 12/1971 | Palmer et al. | |
| 3,748,702 | A | * | 7/1973 | Brown | 188/67 |
| 3,791,442 | A | | 2/1974 | Watkins | |
| 4,098,342 | A | * | 7/1978 | Robinson et al. | 166/385 |
| 4,449,596 | A | | 5/1984 | Boyadjieff | |
| 4,791,997 | A | | 12/1988 | Krasnov | |
| 4,887,673 | A | | 12/1989 | Skoruppa | |
| 5,297,833 | A | * | 3/1994 | Willis et al. | 294/102.2 |
| 5,351,767 | A | | 10/1994 | Stogner et al. | |
| 5,595,248 | A | | 1/1997 | Denny | |
| 5,732,909 | A | | 3/1998 | Sonnier | |
| 5,992,801 | A | | 11/1999 | Torres | |
| 6,047,781 | A | | 4/2000 | Scott et al. | |
| 6,089,338 | A | | 7/2000 | Bouligny, Jr. | |
| 6,237,684 | B1 | | 5/2001 | Bouligny, Jr. et al. | |
| 6,349,764 | B1 | | 2/2002 | Adams et al. | |
| 6,364,012 | B1 | | 4/2002 | Adams et al. | |
| 6,378,614 | B1 | | 4/2002 | Adams et al. | |
| 6,644,413 | B2 | | 11/2003 | Adams et al. | |
| 7,025,147 | B2 | | 4/2006 | Adams et al. | |
| 7,886,827 | B2 | * | 2/2011 | Adams et al. | 166/338 |

FOREIGN PATENT DOCUMENTS

| | | |
|---|---|---|
| WO | WO 03/062584 | 7/2003 |

OTHER PUBLICATIONS

L.D. Davis, "Rotary, Kelly, Swivel, Tongs, and Top Drive," Rotary Drilling Series of Instructional Texts, Unit I, Lesson 4, First Edition, 1995 (more than 4 years earlier than efective filing date of capioned application), pp. 27-39 and 48-62 published by Petroleum Extension Service, Division of Continuing Education, The University of Texas at Austin, in cooperation with International Association of Drilling Contractors.

L.D. Davis, "The Blocks and Drilling Line," Rotary Drilling Series of Instructional Texts, Unit I, Lesson 5, Third Edition, 1996 (more than 3 years earlier than effective filing date of captioned application), pp. 1-2 and 89-92, published by Petroleum Extension Service, Division of Continuing Education, The University of Texas at Austin, in cooperation with International Association of Drilling Contractors.

Tom H. Hill, letter (2 pages) to Mr. Burt Adams datedAug. 20, 2001, with 4 pages of attached drawings.

A.T. Bourgoyne, Jr., et al., "Applied Drilling Engineering," 1991 (more than 9 years earlier than the effective filing dale of the captioned application), vol. 2, p. 19, published by Society of Petroleum Engineers.

* cited by examiner

APPARATUS FOR, AND METHOD OF, LANDING ITEMS AT A WELL LOCATION

CROSS-REFERENCE TO RELATED APPLICATIONS

This is a continuation of U.S. patent application Ser. No. 11/927,847, filed Oct. 30, 2007 (issuing as U.S. Pat. No. 7,886,827 on Feb. 15, 2011), which was a continuation of U.S. patent application Ser. No. 11/402,302, filed Apr. 10, 2006 (issued as U.S. Pat. No. 7,287,598 on Oct. 30, 2007), which was a continuation-in-part of U.S. patent application Ser. No. 10/640,496, filed Aug. 13, 2003 (issued as U.S. Pat. No. 7,025,147 on Apr. 11, 2006), which was a continuation-in-part of U.S. patent application Ser. No. 10/055,005, filed Jan. 23, 2002 (issued as U.S. Pat. No. 6,644,413 on Nov. 11, 2003), which was a continuation-in-part of U.S. patent application Ser. No. 09/586,239, filed Jun. 2, 2000, (issued as U.S. Pat. No. 6,378,614 on Apr. 30, 2002).

Each of these applications are incorporated herein by reference. Priority of each of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an apparatus for, and method of, lowering items from a drilling rig to a well located below the rig for use in the oil and gas well drilling industry. More particularly, the present invention relates to an apparatus for, and method of, lowering items from a drilling rig through the use of a landing string comprised of drill pipe having an enlarged diameter section with a shoulder, in combination with upper and lower holders having wedge members with shoulders that engage and support the drill pipe at the shoulder of the enlarged diameter section.

2. General Background

Oil and gas well drilling and production operations involve the use of generally cylindrical tubes commonly known in the industry as "casing" which line the generally cylindrical wall of the borehole which has been drilled in the earth. Casing is typically comprised of steel pipe in lengths of approximately 40 feet, each such length being commonly referred to as a "joint" of casing. In use, joints of casing are attached end-to-end to create a continuous conduit. In a completed well, the casing generally extends the entire length of the borehole and protects the production tubing that conducts oil and gas from the producing formation to the top of the borehole, where one or more blowout preventors or production trees may be located on the sea floor.

Casing is generally installed or "run" into the borehole in phases as the borehole is being drilled. The casing in the uppermost portion of the borehole, commonly referred to as "surface casing," may be several hundred to several thousand feet in length, depending upon numerous factors including the nature of the earthen formation being drilled and the desired final depth of the borehole.

After the surface casing is cemented into position in the borehole, further drilling operations are conducted through the interior of surface casing as the borehole is drilled deeper and deeper. When the borehole reaches a certain depth below the level of the surface casing, depending again on a number of factors such as the nature of the formation and the desired final depth of the borehole, drilling operations are temporarily halted so that the next phase of casing installation, commonly known as intermediate casing, may take place.

Intermediate casing, which may be thousands of feet in total length, is typically made of "joints" of steel pipe, each joint typically being in the range of about 38 to 42 feet in length. The joints of intermediate casing are attached end-to-end, typically through the use of threaded male and female connectors located at the respective ends of each joint of casing.

In the process of installing the intermediate casing, joints of intermediate casing are lowered longitudinally through the floor of the drilling rig. The length of the column of intermediate casing grows as successive joints of casing are added, generally one to four at a time, by drill hands and/or automated handling equipment located on the floor of the drilling rig.

When the last intermediate casing joint has been added, the entire column of intermediate casing, commonly referred to as the intermediate "casing string", must be lowered further into its proper place in the borehole. The task of lowering the casing string into its final position in the borehole is accomplished by adding joints of drill pipe to the top of the casing string. The additional joints of drill pipe are added, end-to-end, by personnel and/or automated handling equipment located on the drilling rig, thereby creating a column of drill pipe known as the "landing string." With the addition of each successive joint of drill pipe to the landing string, the casing string is lowered further and further.

During this process as practiced in the prior art, when an additional joint of drill pipe is being added to the landing string, the landing string and casing string hang from the floor of the drilling rig, suspended there by a holder or gripping device commonly referred to in the prior art as "slips." When in use, the slips generally surround an opening in the rig floor through which the upper end of the uppermost joint of drill pipe protrudes, holding it there a few feet above the surface of the rig floor so that rig personnel and/or automated handling equipment can attach the next joint(s) of drill pipe.

The inner surface of the prior art slips has teeth-like grippers and is curved such that it corresponds with the outer surface of the drill pipe. The outer surface of prior art slips is tapered such that it corresponds with the tapered inner or "bowl" face of the master bushing in which the slips sit.

When in use, the inside surface of the prior art slips is pressed against and "grips" the outer surface of the drill pipe which is surrounded by the slips. The tapered outer surface of the slips, in combination with the corresponding tapered inner face of the master bushing in which the slips sit, cause the slips to tighten around the gripped drill pipe such that the greater the load being carried by that gripped drill pipe, the greater the gripping force of the slips being applied around that gripped drill pipe. Accordingly, the weight of the casing string, and the weight of the landing string being used to "run" or "land" the casing string into the borehole, affects the gripping force being applied by the slips, i.e., the greater the weight the greater the gripping force and crushing effect.

As the world's supply of easy-to-reach oil and gas formations is being depleted, a significant amount of oil and gas exploration has shifted to more challenging and difficult-to-reach locations such as deep-water drilling sites located in thousands of feet of water. In some of the deepest undersea wells drilled to date, wells may be drilled from a rig situated on the ocean surface some 5,000 to 10,000 feet above the sea floor, and such wells may be drilled some 15,000 to 25,000 feet below the sea floor. It is envisioned that as time goes on, oil and gas exploration will involve the drilling of even deeper holes in even deeper water.

For many reasons, including the nature of the geological formations in which unusually deep drilling takes place and is expected to take place in the future, the casing strings required for such wells must be unusually long and must have unusually thick walls, which means that such casing strings are unusually heavy and can be expected in the future to be even heavier. Moreover, the landing string needed to land the casing strings in such extremely deep wells must be unusually long and strong, hence unusually heavy in comparison to landing strings required in more typical wells.

For example, a typical well drilled in an offshore location today may be located in about 300 to 2000 feet of water, and may be drilled 15,000 to 20,000 feet into the sea floor. Typical casing for such a typical well may involve landing a casing string between 15,000 to 20,000 feet in length, weighing 40 to 60 pounds per linear foot, resulting in a typical casing string having a total weight of between 600,000 to 1,200,000 pounds. The landing string required to land such a typical casing string may be 300 to 2000 feet long which, at about 35 pounds per linear foot of landing string, results in a total landing string weight of 10,500 to 70,000 pounds. Hence, prior art slips in typical wells have typically supported combined landing string and casing string weight in the range of between about 610,500 to 1,270,000 pounds.

By way of contrast, extremely deep undersea wells located in 5,000 to 10,000 feet of water, uncommon today but expected to be more common in the future, may involve landing a casing string 15,000 to 20,000 feet in length, weighing 40 to 80 pounds per linear foot, resulting in a total casing string weight of 600,000 to 1,600,000 pounds. The landing string required to land such casing strings in such extremely deep wells may be 5,000 to 10,000 feet long which, at 70 pounds per linear foot, results in a total landing string weight of about 350,000 to 700,000 pounds. Hence, the combined landing string and casing string weight for extremely deep undersea wells may be in the range of 950,000 to 2,300,000 pounds, instead of the 610,500 to 1,270,000 pound range generally applicable to more typical wells. In the future, as deeper wells are drilled in deeper water, the combined landing string and casing string weight can be expected to increase, perhaps up to as much as 4,000,000 pounds or more.

Under certain circumstances, prior art slips have been able to support the combined landing string and casing string weight of 610,500 to 1,270,000 pounds associated with typical wells, depending upon the size, weight and grade of the pipe being held by the slips. In contrast, prior art slips cannot effectively and consistently support the combined landing string and casing string weight of 950,000 to 2,300,000 pounds associated with extremely deep wells, because of numerous problems which occur at such extremely heavy weights.

For example, prior art slips used to support combined landing string and casing string weight above the range of about 610,500 to 1,270,000 pounds have been known to apply such tremendous gripping force that (a) the gripped pipe has been crushed or otherwise deformed and thereby rendered defective, (b) the gripped pipe has been excessively scored and thereby damaged due to the teeth-like grippers on the inside surface of the prior art slips being pressed too deeply into the gripped drill pipe and/or (c) the prior art slips have experienced damage rendering them inoperable.

A related problem involves the uneven distribution of force applied by the prior art slips to the gripped pipe joint. If the tapered outer wall of the slips is not substantially parallel to and aligned with the tapered inner wall of the master bushing, that can create a situation where the gripping force of the slips in concentrated in a relatively small portion of the inside wall of the slips rather than being evenly distributed throughout the entire inside wall of the slips. Such concentration of gripping force in such a relatively small portion of the inner wall of the slips can (a) crush or otherwise deform the gripped drill pipe, (b) result in excessive and harmful strain or elongation of the drill pipe below the point where it is gripped and (c) cause damage to the slips rendering them inoperable.

This uneven distribution of gripping force is not an uncommon problem, as the rough and tumble nature of oil and gas well drilling operations cause the slips and/or master bushing to be knocked about, resulting in misalignment and/or irregularities in the tapered interface between the slips and the master bushing. This problem is exacerbated as the weight supported by the slips is increased, which is the case for extremely deep wells as discussed above.

BRIEF SUMMARY OF THE INVENTION

The present invention does away with the use of prior art slips and provides for the use of upper and lower holders which support the drill pipe without crushing, deforming, scoring or causing elongation of the drill pipe being held. The present invention includes the use of wedge members which can be raised out of and lowered into the holders.

The present invention provides for the use of the holders in combination with an enlarged diameter section of the drill pipe which is spaced apart from the ends of the drill pipe.

The enlarged diameter section has a shoulder which corresponds to a shoulder on the movable wedge members of the holders. The engagement of such shoulders provides support for the drill pipe being held without any of the problems associated with the prior art slips, regardless of the weight of the landing string and casing string.

The corresponding shoulders are so configured that they are fully rotatable with respect to each other. Hence, no specific radial alignment of the shoulders is required prior to or during engagement between said corresponding shoulders.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
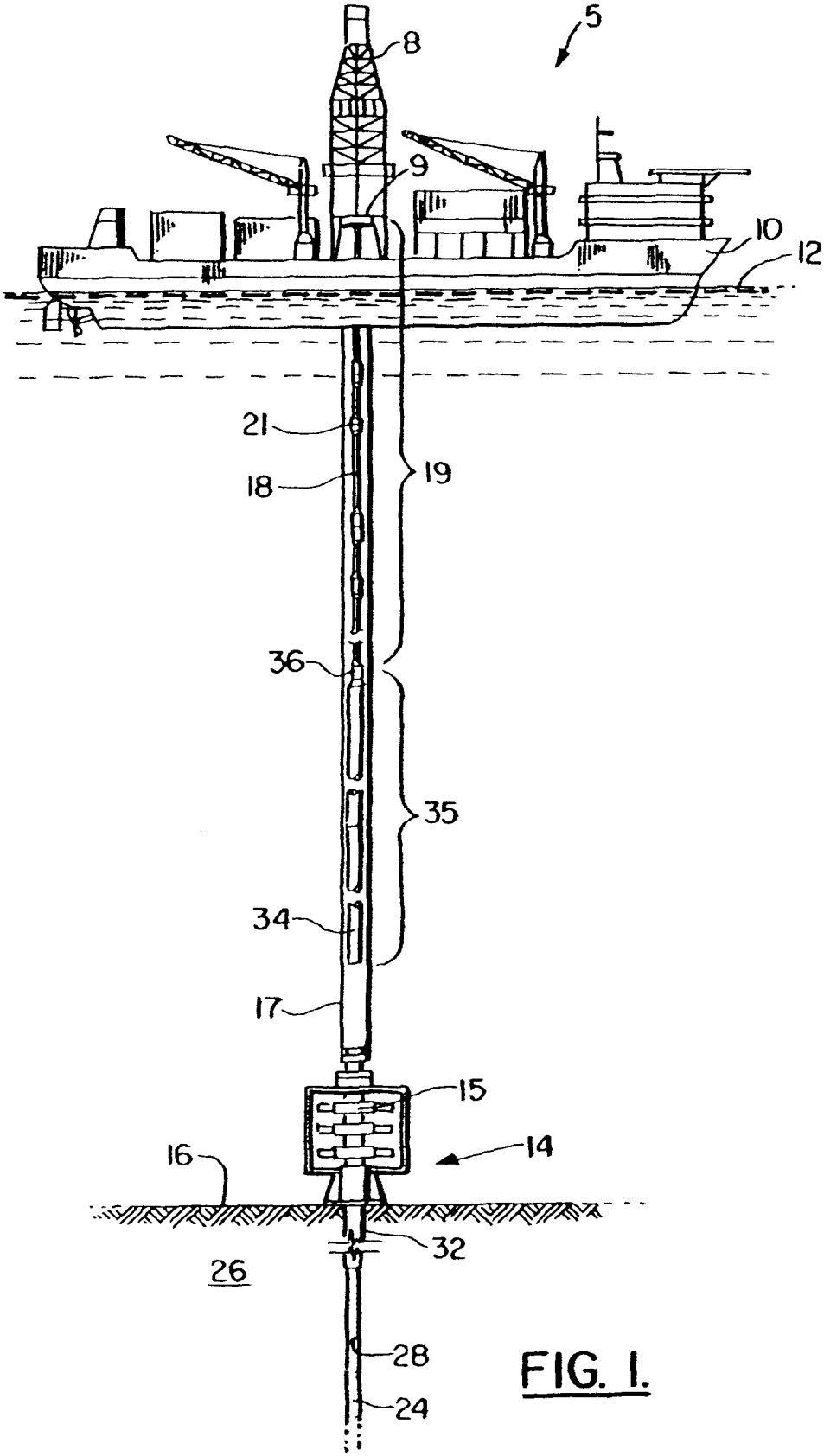
FIG. 1 is an overall elevational view of a drilling rig situated on a floating drill ship, said drilling rig supporting a landing string and casing string extending therefrom in accordance with the present invention toward the borehole that has been drilled into the sea floor.

FIG. 1 depicts generally the present invention 5 in overview. As shown in FIG. 1, drill ship 10 has drilling rig 8 that is situated above ocean surface 12 over the location of undersea well 14 that is drilled below sea floor 16. Numerous lengths or "joints" of drill pipe 18 in accordance with the present invention, attached end-to-end and collectively known as "landing string" 19, extend from rig 8. Numerous lengths or "joints" of casing 34, attached end-to-end and collectively known as "casing string" 35, extend below landing string 19 and are attached to landing string 19 via crossover connection 36. The landing string 19, crossover connection 36 and casing string 35 are situated longitudinally within riser 17 which extends from the rig 8 to undersea well 14.

Figure 2:
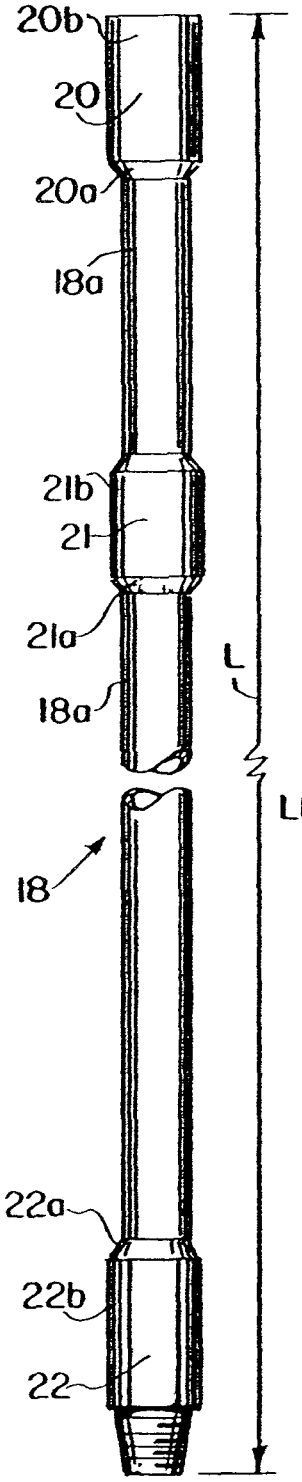
FIG. 2 is an elevational view of drill pipe in accordance with the present invention.
Figure 3:
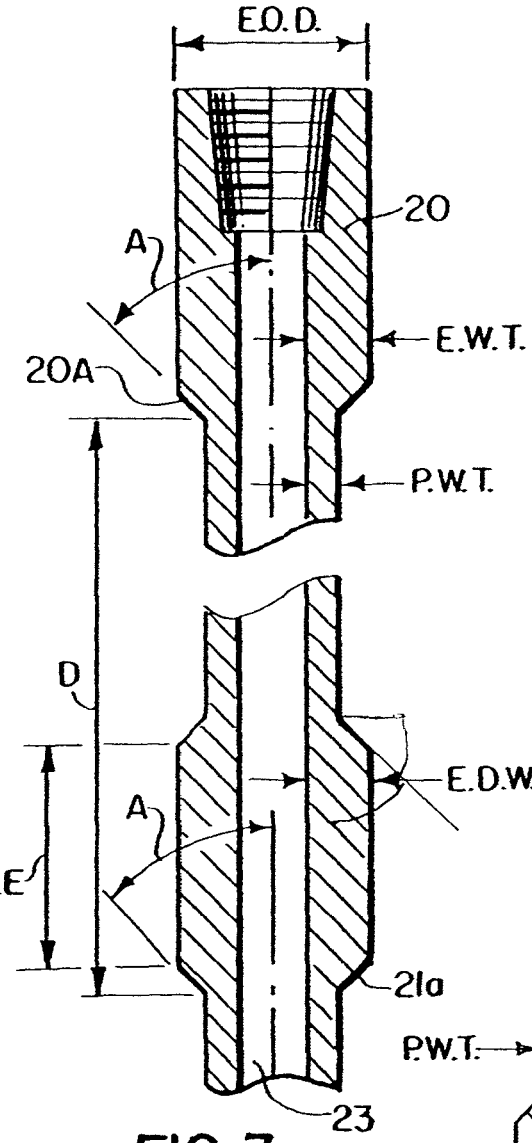
FIGS. 3 and 4 are fragmentary, sectional, elevational views of drill pipe in accordance with the present invention.

FIG. 2 shows a drill pipe 18 in accordance with the present invention. In addition to a female or "box" end 20 and a male or "pin" end 22, drill pipe 18 of the present invention also has an enlarged diameter section 21 which is spaced apart from box end 20 and pin end 22. Enlarged diameter section 21 has a shoulder 21*a* which is preferably tapered as shown in FIGS. 2 and 3. Shoulder 21*a* surrounds at least a part and preferably all of the circumferential perimeter of drill pipe 18.

Figure 10:
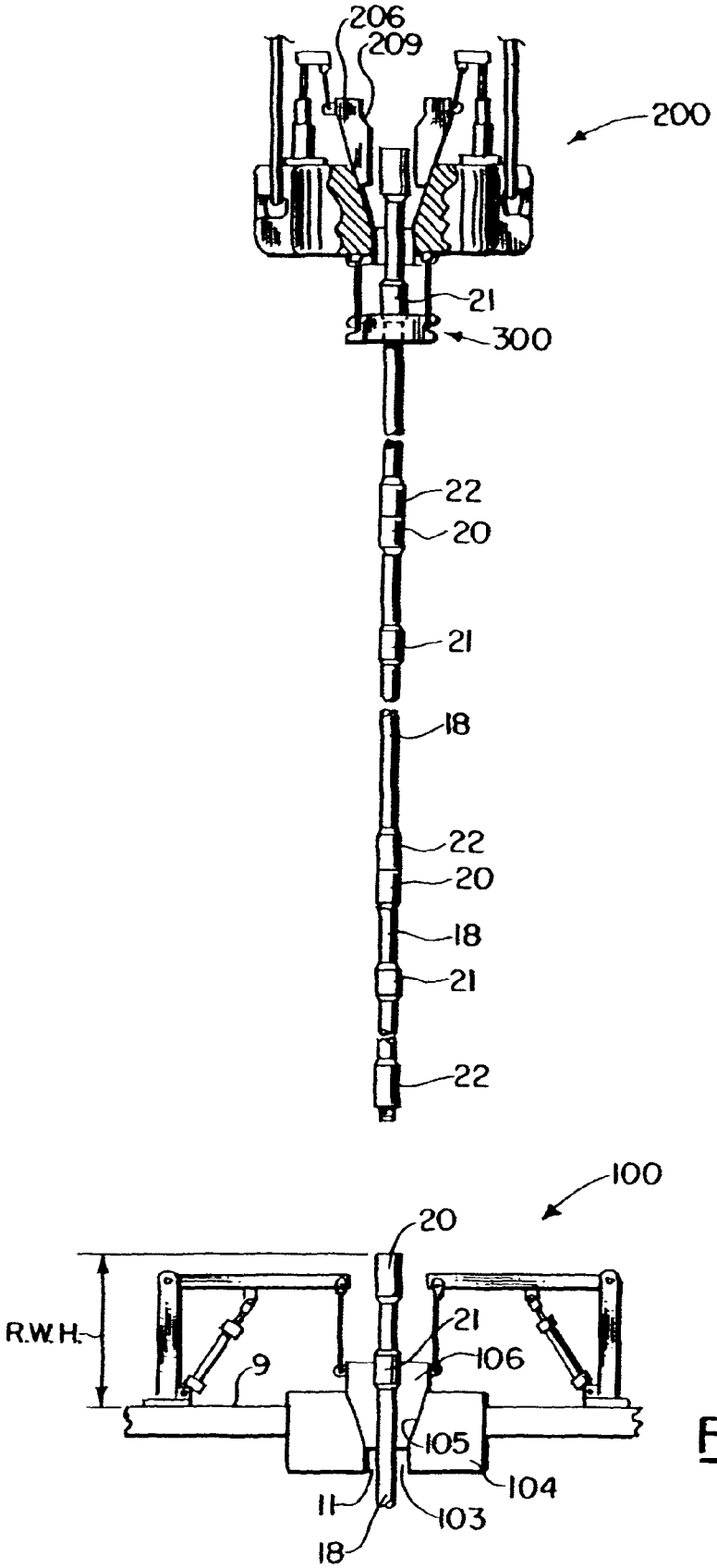
FIG. 10 is an elevational view of the drill pipe and a first embodiment of the upper and lower holders in accordance with the present invention, in which the lower holder is supporting the landing string extending from the drilling rig, and the auxiliary upper holder is supporting the weight of the joints of drill pipe being added to or removed from the landing string.

Also in accordance with the present invention, FIG. 10 shows lower drill pipe holder 100 for supporting the landing string 19 during the addition or removal of one or more joints of drill pipe 18 to or from landing string 19. Lower holder 100 is preferably located at the drilling rig floor 9, where it may be situated in or adjacent to the floor.

As also shown in FIG. 10, lower holder 100 includes main body 104 which generally surrounds an opening 11 in rig floor 9 through which landing string 19 protrudes. Main body 104 has an opening 103 and a tapered inner face 105 which defines a tapered bowl generally surrounding landing string 19 which protrudes therethrough.

Figure 5:
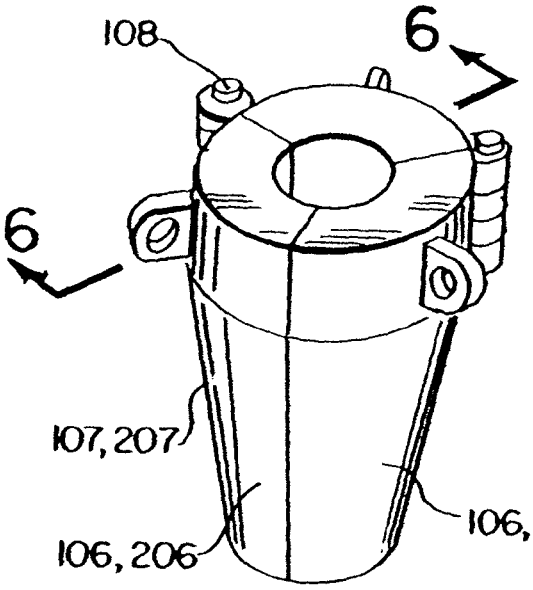
FIG. 5 is a perspective view of a first embodiment of the wedge members of the lower and upper holders of the present invention, hinged together and closed.
Figure 7:
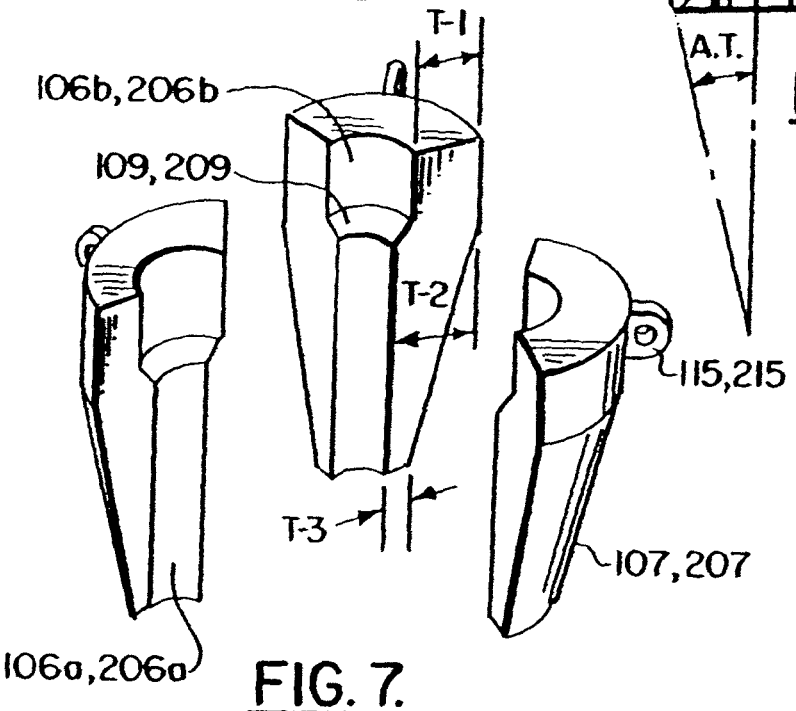
FIG. 7 is a perspective view of the first embodiment of the individual, unconnected wedge members of the lower and upper holders of the present invention.
Figure 8:
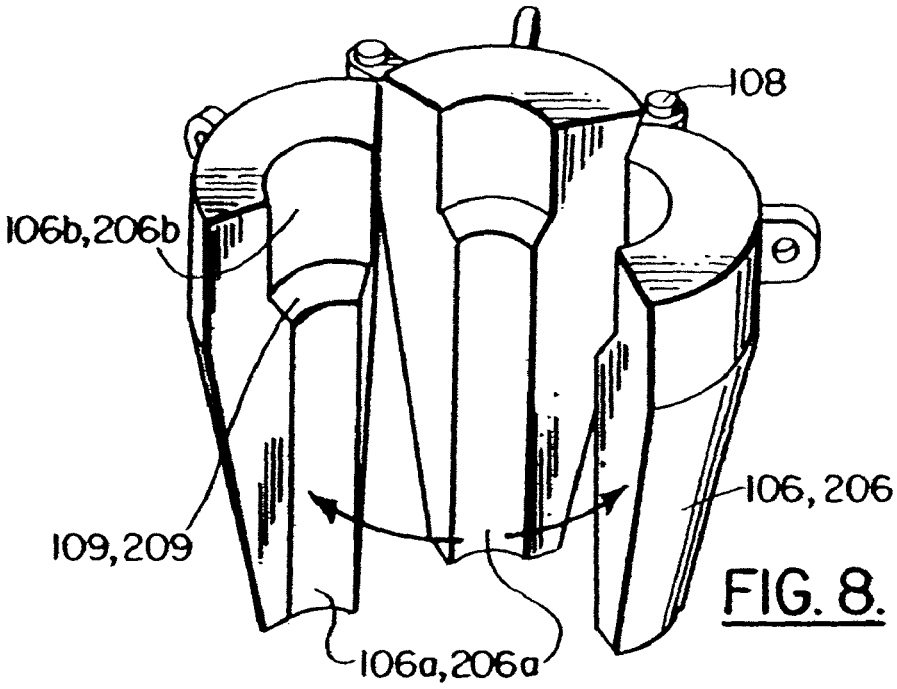
FIG. 8 is a perspective view of the first embodiment of the wedge members of the lower and upper holders of the present invention hinged together in an open position.
Figure 11:
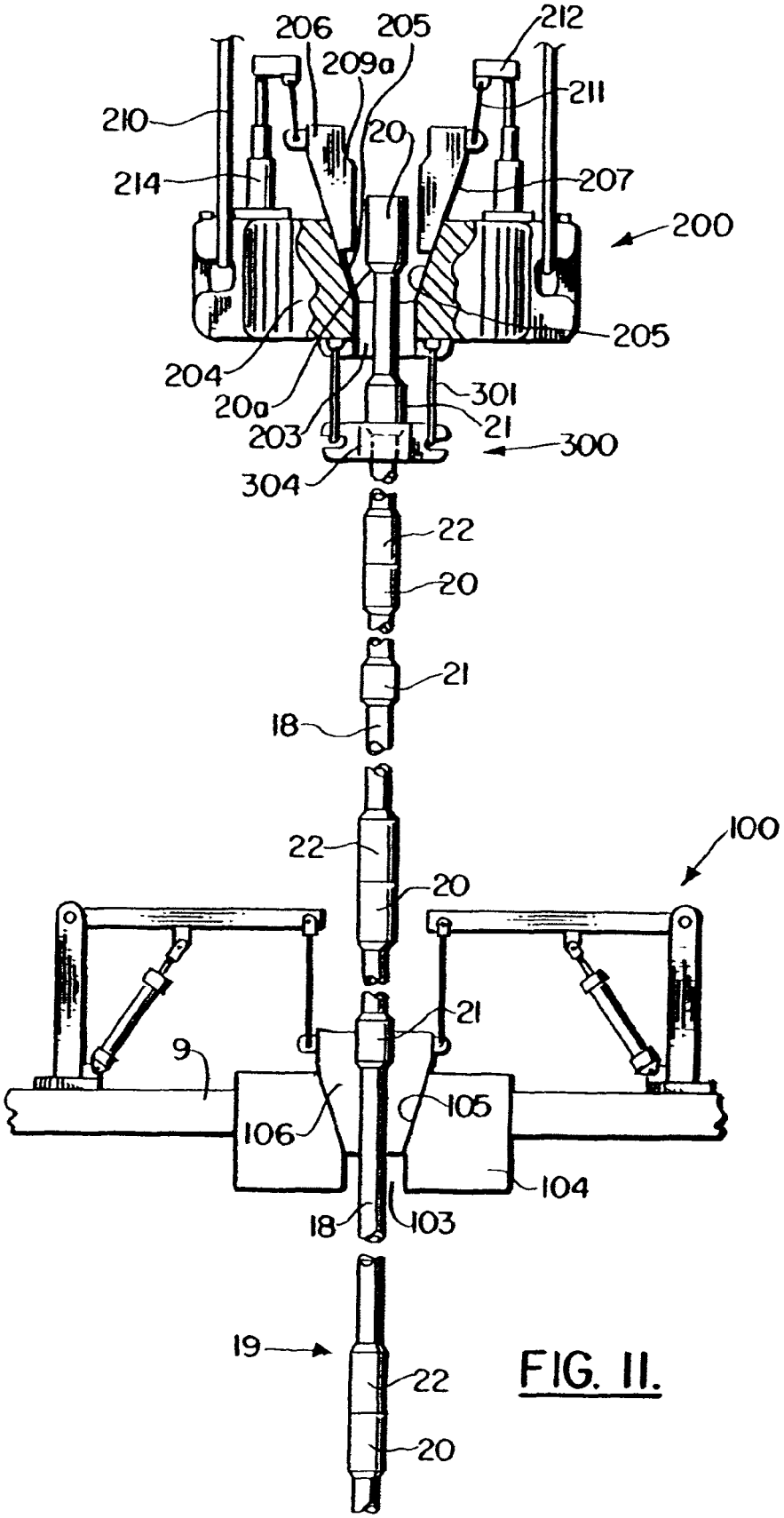
FIG. 11 is an elevational view of the drill pipe and the first embodiment of the holders in accordance with the present invention, wherein the landing string is being supported by the lower holder, and wherein additional joints of drill pipe have either been just added to or are about to be removed from the landing string being held by the lower holder.
Figure 12:
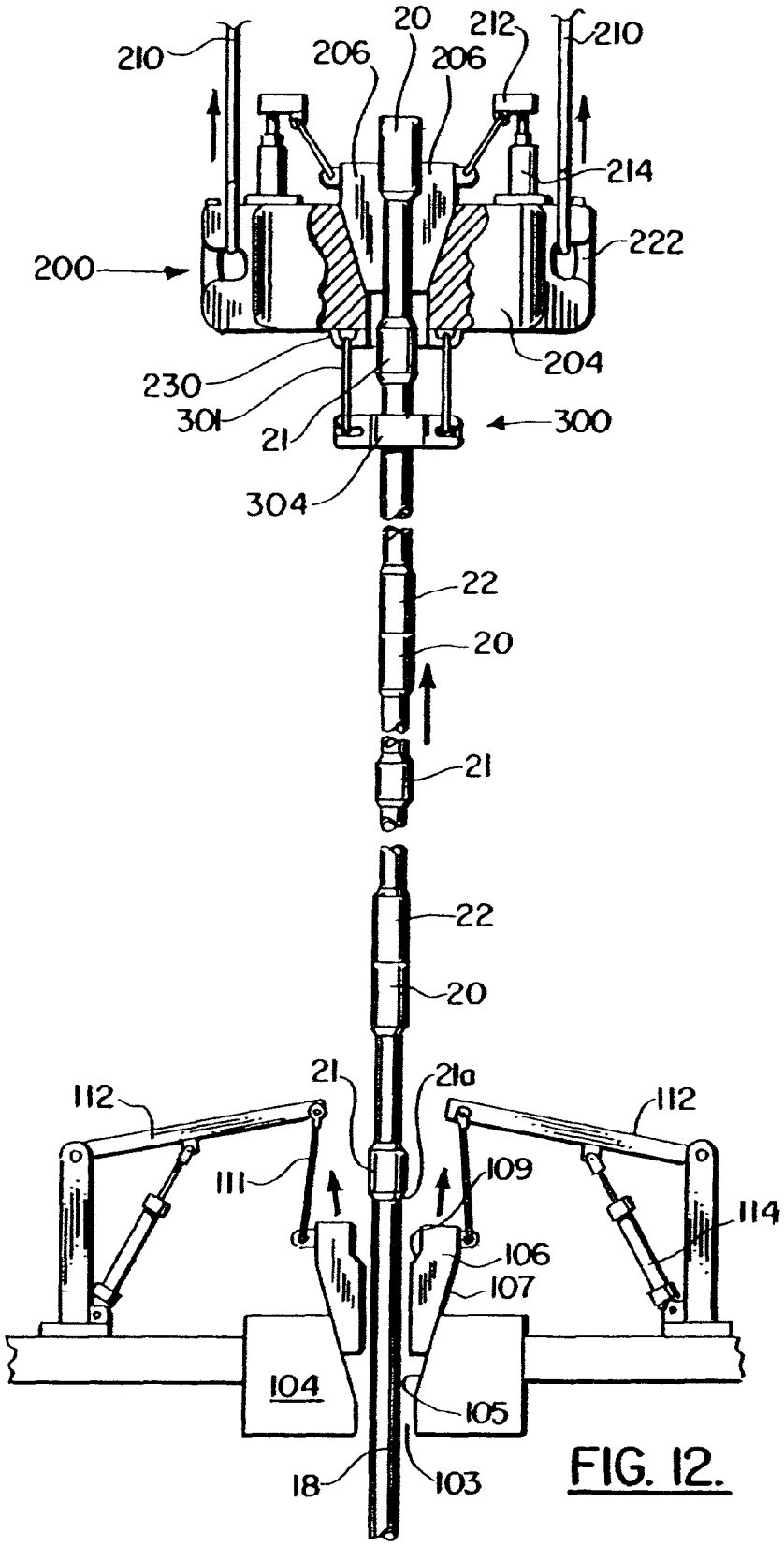
FIG. 12 in an elevational view of the drill pipe and the first embodiment of the holders in accordance with the present invention, wherein the landing string is supported by the upper holder, and wherein the upper holder and the wedges of the lower holder are being raised slightly so as to clear the wedge members of the lower holder from around the drill pipe prior to lowering the joints of drill pipe which have been added, or, alternatively, where the upper holder has just been used to pull several joints of landing string up as in "tripping out" of the hole.

Lower holder 100 also includes one or more wedge members 106, as depicted in FIGS. 10, 11 and 12. As shown in FIG. 7, the wedge members 106 of the present invention can be three in number and may be connected by hinges 108 as shown in FIGS. 5 and 8. Wedge members 106 have a tapered outer face 107, as shown in FIGS. 5 and 7, which corresponds with the tapered inner face 105 of main body 104, as shown in FIGS. 11 and 12. The tapered bowl in main body 104 which is defined by its tapered inner face 105 receives wedge members 106 as best depicted in FIGS. 10 and 11.

Figure 6:
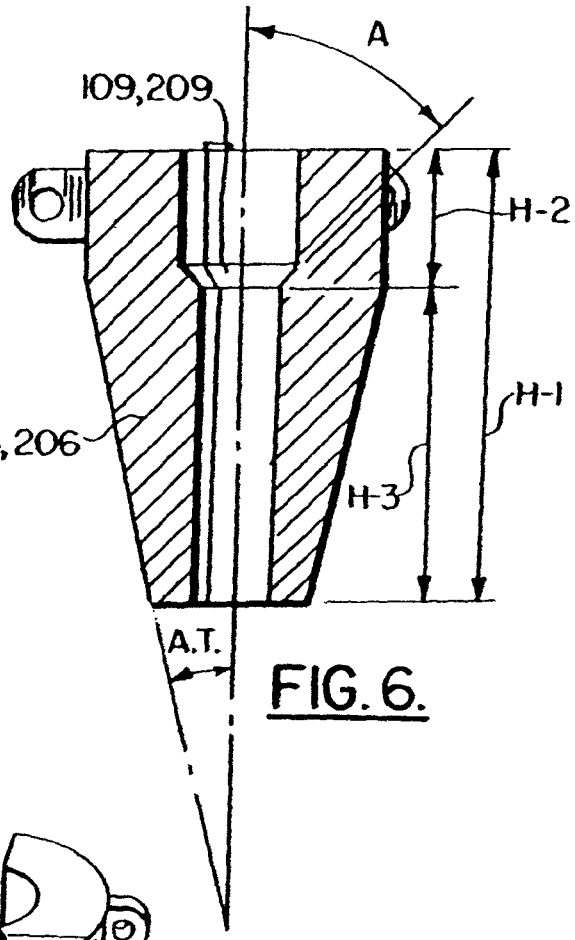
FIG. 6 is a cross sectional view taken along lines 6-6 in FIG. 5.

As shown in FIGS. 6 and 7, the inner side of wedge member 106 has a tapered shoulder 109. Tapered shoulder 109 corresponds with tapered shoulder 21*a* of enlarged diameter section 21 of drill pipe 18, as best shown in FIGS. 11 and 12. Tapered shoulder 109 of wedge member 106 is curved, as shown in FIGS. 7 and 8, to correspond with the curved, circumferential shape of shoulder 21*a* of enlarged diameter section 21. The inner side of wedge member 106 also has a curved surface 106*a*, as best shown in FIGS. 7 and 8, which corresponds with and accommodates the curved outer surface 18*a* of drill pipe 18. The inner side of wedge member 106 also has curved surface 106*b*, as best shown in FIGS. 7 and 8, which corresponds with and accommodates the curved outer surface 21*b* of enlarged diameter section 21 of drill pipe 18.

When wedge members 106 are in place in main body 104, as shown in FIGS. 10 and 11, the wedge members form an interface between body 104 and the joint of drill pipe 18 being held by holder 100, the engagement between shoulder 109 of wedge member 106 and shoulder 21*a* of enlarged diameter section 21 providing support for the drill pipe 18 being held by the holder 100.

It should be understood that lower holder 100 of the present invention provides support for landing string 19 by the engagement of shoulder 109 of wedge member 106 with shoulder 21*a* of enlarged diameter section 21 of drill pipe 18. Accordingly, unlike prior art slips, it is not necessary for the curved inner surface 106*a* of wedge member 106 to have teeth-like grippers or bear against the drill pipe 18 being supported by the holder. Hence, the present invention overcomes the problems associated with crushing, deformation, scoring and uneven distribution of gripping force associated with prior art slips.

It should be understood that drill pipe 18, depicted in FIG. 10 as being supported by lower holder 100, is the uppermost length or "joint" of drill pipe in landing string 19 depicted in FIG. 1. It should also be understood that lower holder 100 of the present invention supports not only drill pipe 18 which appears in FIG. 10, but also the entire attached landing string 19 and casing string 35 extending from rig 8, as best shown in FIG. 1. In extremely deep wells drilled in extremely deep water for which the present invention is particularly suited, the combined weight of landing string 19 and casing string 35 may range from 950,000 to 2,300,000 pounds. In the future, as deeper wells are drilled in deeper water, it is expected that the present invention may be supporting combined landing string and casing string weight of 4,000,000 pounds or more.

FIG. 1 depicts the installation or "running" of intermediate casing string 35, which will be lowered longitudinally, through blowout preventors 15 and surface casing 32, into position in borehole 24. Although FIG. 1 shows surface casing 32 already cemented into position in borehole 24, it should be understood that the present invention may not only be used to run intermediate casing, but surface and production casing as well. It should also be understood that the present invention, in addition to being used to land casing strings, may also be used to land any other items on or below the sea floor such as blow out preventors, subsea production facilities, subsea wellheads, production strings, drill pipe and drill bits. It should be specifically understood that drill pipe 18 of the present invention may be used in the drilling operation, with drilling fluid being circulated through the lumen 23 of drill pipe 18.

In order to lower casing string 35 from the position shown in FIG. 1 into borehole 24, additional joints of drill pipe 18 are added, usually 1 to 4 at a time, above the joint of drill pipe 18 being held by holder 100, as shown in FIG. 10. FIG. 10 shows three additional joints of drill pipe 18 about to be added, although it should be understood that the number of joints of drill pipe added at a time may vary.

Figure 13:
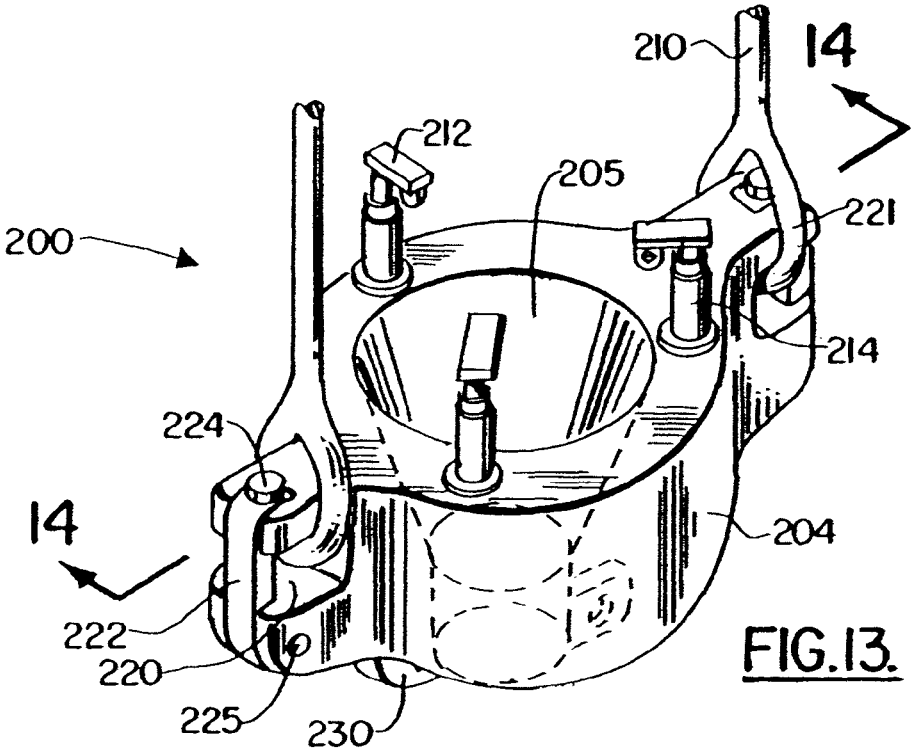
FIG. 13 is a perspective view showing the first embodiment of the upper holder without its wedge members and without the auxiliary upper holder.

After the additional joint or joints of drill pipe 18 have been attached, as shown in FIG. 11, landing string 19 and attached casing string 35 may be lowered by a distance roughly equivalent to the length of the newly added joints of drill pipe. This is accomplished via upper holder 200 of the present invention, as depicted in FIG. 11. Upper holder 200 is supported by elevator bails or "links" 210 which in turn are attached to the rig lifting system (not shown). Upper holder 200 includes a main body 204 having an opening 203 which may accommodate the passage of drill pipe 18 therethrough. The opening 203 of main body 204 has a tapered inner face 205 which defines a tapered bowl, as best shown in FIG. 13.

Upper holder 200 also includes one or more wedge members 206 having a tapered outer face 207 which corresponds with the tapered inner face 205 of main body 204. The tapered bowl in main body 204 defined by its tapered inner face 205 receives wedge members 206 as shown in FIGS. 11 and 12. Wedge members 206 of the present invention may be three in number and may be connected by hinges, similar to wedge members 106 as depicted in FIGS. 5 and 7.

Wedge members 206 of upper holder 200 may be shaped and configured similar to wedge members 106 of lower holder 100, although there may be slight variations in size and/or dimensions between wedge members 106 and 206. Similar to tapered shoulder 109 of wedge member 106 as depicted in FIGS. 6 through 8, the inner side of wedge member 206 has a tapered shoulder 209. As shown in FIG. 11, tapered shoulder 209 of wedge member 206 corresponds with tapered shoulder 20*a* of box end 20 of drill pipe 18. Similar to tapered shoulder 109 of wedge member 106, tapered shoulder 209 of wedge member 206 is curved to correspond with and accommodate the curved, circumferential shape of shoulder 20*a* of box end 20.

When wedge members 206 are in place in main body 204, as shown in FIG. 12, the engagement between shoulder 209 of wedge member 206 and shoulder 20*a* of box end 20 of drill pipe 18 being held by holder 200 provides support for said drill pipe 18 being held by holder 200. Similar to curved surface 106*a* on the inner side of wedge member 106 as shown in FIGS. 7 and 8, the inner side of wedge member 206 also has a curved surface 206*a* which corresponds with and accommodates the curved outer surface 18A of drill pipe 18. Similar to curved surface 106*b* on the inner side of wedge member 106 as best shown in FIGS. 7 and 8, the inner side of wedge member 206 also has a curved surface 206*b* which corresponds with and accommodates the curved outer surface 20*b* of box end 20 of drill pipe 18.

When wedge members 206 are in place in main body 204 of upper holder 200, as shown in FIG. 12, said wedge members form an interface between body 204 and the joint of drill pipe 18 being held by holder 200. In that position, as depicted in FIG. 12, the rig lifting system (not shown) can be used to slightly lift upper holder 200. When that happens, upper holder 200 is supporting the entire load including the landing string 19 and casing string 35, thereby taking the load off wedge members 106 of lower holder 100. Wedge members 106 can then be disengaged, i.e., wholly or partially moved up and away from drill pipe 18, providing sufficient clearance for the landing string 19 to pass unimpeded through the opening 103 in main body 104 of lower holder 100.

Figure 15:
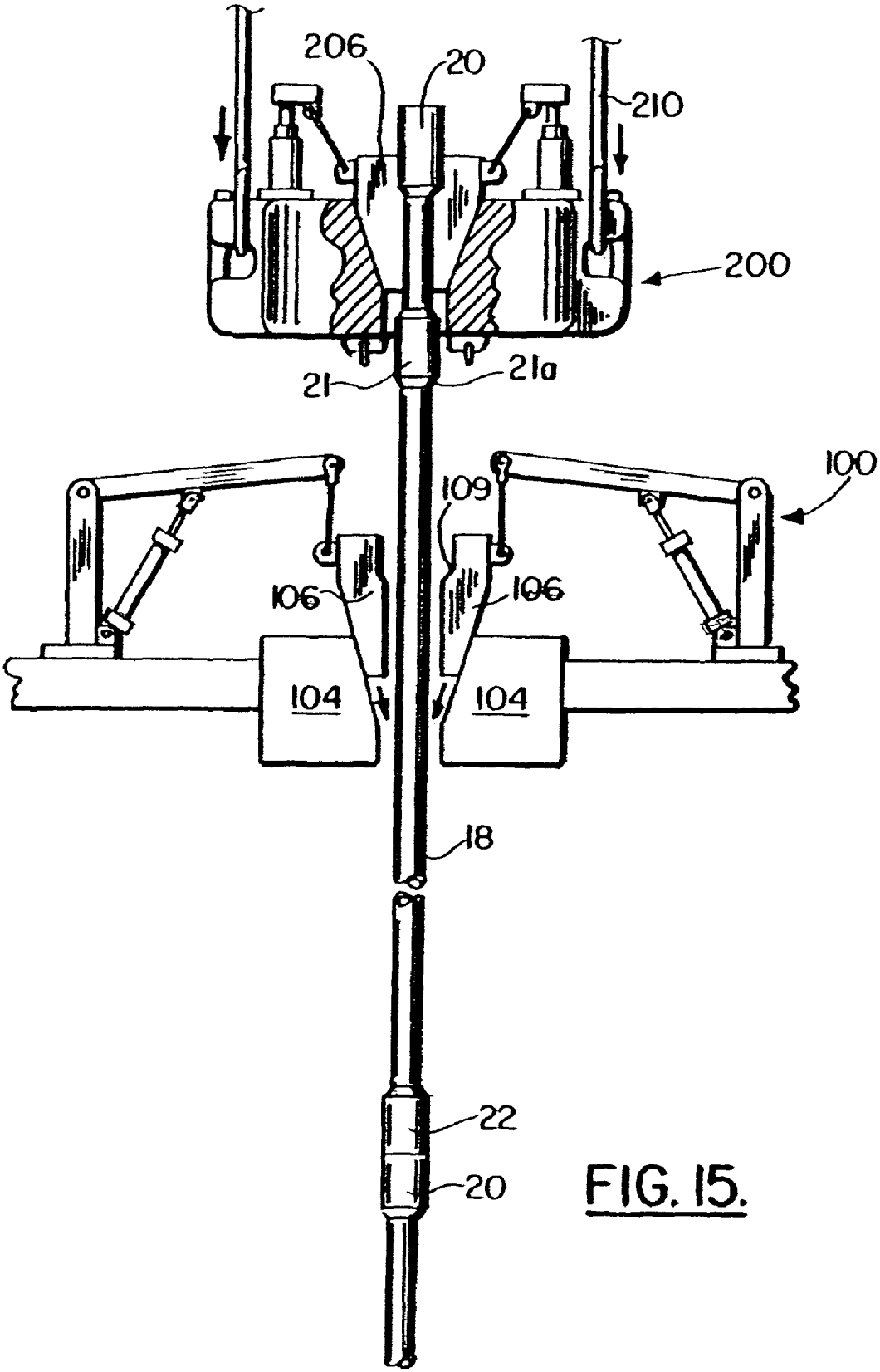
FIG. 15 is an elevational view of the drill pipe and the first embodiment of the upper and lower holders of the present invention wherein the upper holder has just lowered the drill pipes that were added and wherein the weight of the landing string is about to be transferred from the upper holder to the lower holder.
Figure 16:
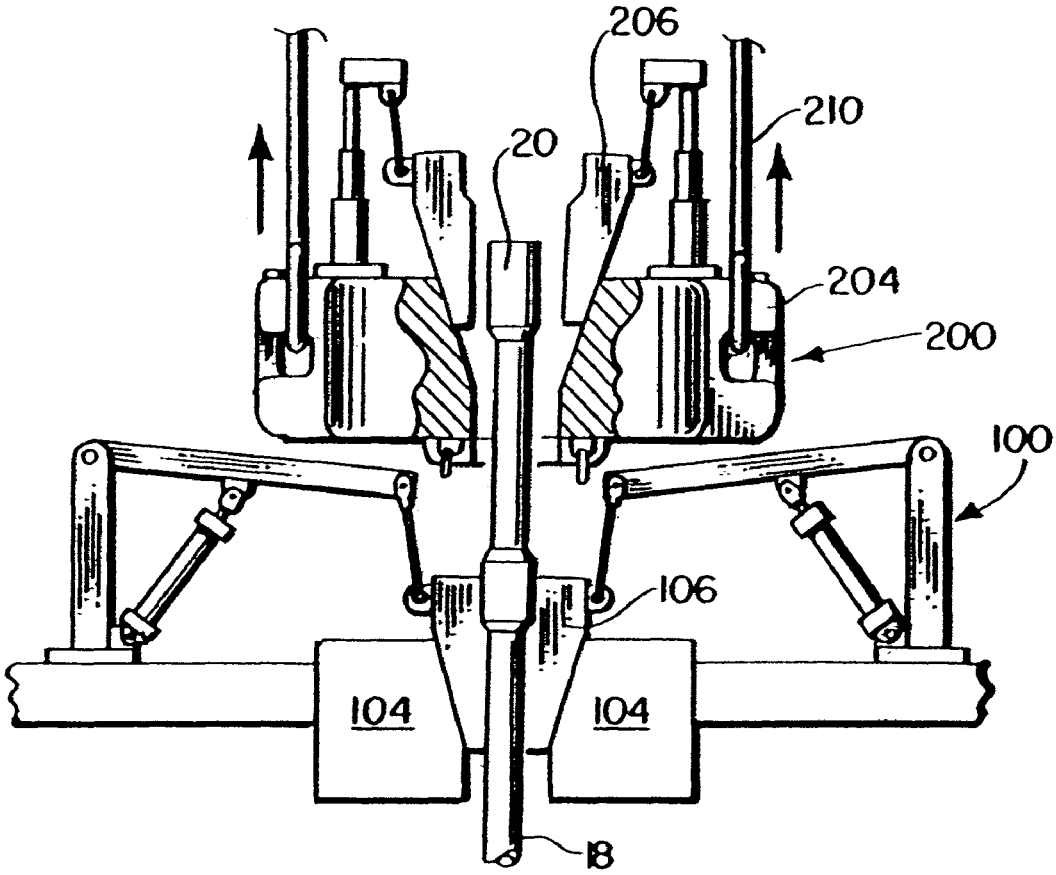
FIG. 16 is an elevational view of the drill pipe and the first embodiment of the upper and lower holders of the present invention wherein the lower holder is supporting the weight of the landing string and wherein the upper holder is about to be hoisted up so that additional joints of drill pipe may be added to the landing string or, alternatively, wherein the upper holder is about to engage and support the landing string in preparation for "tripping out" of the hole.

The rig lifting system may then be used to lower upper holder 200, along with the landing string and casing string it is supporting, by a distance roughly equivalent to the length of the newly added joints of drill pipe. More specifically, upper holder 200 is lowered until the uppermost enlarged diameter section 21 of newly added drill pipe 18 is located a distance above main body 104 of holder 100 sufficient to provide the vertical clearance needed for reinsertion of wedge members 106 in main body 104, as shown in FIG. 15. At that point, wedge members 106 of lower holder 100 may be placed back into position in main body 104 of holder 100. Upper holder 200 may then be slightly lowered further so as to bring into supporting engagement shoulder 109 of wedge members 106 with shoulder 21*a* of the uppermost enlarged diameter section 21 of newly added drill pipe 19, as shown in FIG. 16. In this fashion, the entire load including the landing string and the casing string is transferred from upper holder 200 to lower holder 100.

Upper holder 200 can then be cleared away from the uppermost end of the landing string. This is accomplished by lowering holder 200 slightly such that wedge members 206 can be disengaged, i.e., moved up and away from box end 20 that was previously being held by holder 200, as shown in FIG. 16. Holder 200 can then be hoisted up by the rig lifting system, permitting clearance for yet additional joints of drill pipe to be added to the upper end of the landing string.

As this process is repeated over and over again, casing string 35 is lowered further and further. This process continues until such time as casing string 35 reaches its proper location in borehole 24, at which point the overall length of landing string 19 spans the distance between rig 8 and undersea well 14.

It should be understood that the rig lifting system referenced herein may be a conventional system available in the industry, such as a National Oilwell 2040-UDBE draworks, a Dreco model "872TB-1250" traveling block and a Varco-BJ "DYNAPLEX" hook, model 51000, said system being capable of handling in excess of 2,000,000 pounds.

Some rigs have specialized equipment to hold aloft additional joints of drill pipe as they are being added to the landing string. However, for those rigs that do not have such specialized equipment, the present invention provides for auxiliary upper holder 300, as shown in FIGS. 10 and 11. Auxiliary holder 300 is suspended below upper holder 200 by connectors 301. Connectors 301 may be cables, links, bails, slings or other mechanical devices which serve to connect auxiliary holder 300 to upper holder 200.

Auxiliary holder 300 has a main body 304 which can be moved from an opened to a closed position, allowing it to capture and hold aloft the joints of drill pipe 18 to be added to the pipe string, as shown in FIG. 10. The inner surface of main body 304 includes a tapered shoulder which corresponds with tapered shoulder 21*a*. The inner surface of main body 304 is sized to accommodate drill pipe 18 such that when main body 304 is in its closed position and supporting the joints of drill pipe to be added, as shown in FIG. 10, the tapered shoulder of main body 304 engages tapered shoulder 21*a*, providing support for the joints of drill pipe being added. When upper holder 200 is to be used to lower the entire load to the position shown in FIG. 15, auxiliary holder 300 can be swung back, up and out of the way, so that it does not interfere with lower holder 100. Because the combined weight of the relatively few joints of drill pipe being added at any one time is significantly less than the combined weight of the landing string and the casing string extending below the rig, the size and strength of auxiliary upper holder 300 may be substantially less than that of upper holder 200. Auxiliary holder 300 may be a conventional elevator available in the industry, such as the 25-ton model "MG" manufactured by Access Oil Tools.

It should be understood that while the present invention is particularly useful for landing casing strings and other items, the invention may also be used to retrieve items. For example, the invention may be employed to retrieve the landing string and any items attached thereto, such as a drill bit, in an operation commonly referred to as "tripping out of the hole," wherein the operations described hereinabove are essentially reversed. While the landing string is being supported by lower holder 100, as shown in FIG. 16, upper holder 200 is lowered to the position shown in FIG. 16. Wedge members 206 may then be lowered into main body 204 of upper holder 200 so that shoulder 209 of wedge member 206 is brought into supporting engagement with shoulder 20*a* of box end 20.

At that point, the rig lifting system may be used to lift holder 200, thereby transferring the landing string load from lower holder 100 to upper holder 200. This allows wedge members 106 of lower holder 100 to be wholly or partially moved up and away from drill pipe 18, providing sufficient clearance for pipe string 19 to pass unimpeded through the opening 103 in main body 104.

When tripping out of the hole, it is common practice to pull up two or more joints at a time, as would be the case shown in FIG. 12. The landing string would be pulled up by upper holder 200 such that the enlarged diameter section 21 of the drill pipe to be held by lower holder 100 is slightly above wedge members 106, as is shown in FIG. 12. At that point, wedge members 106 would be lowered into position in main body 104. Upper holder 200 may then be slightly lowered further so as to bring into supporting engagement shoulder 109 of wedge member 106 with shoulder 21*a* of enlarged diameter section 21 of the drill pipe being held in holder 100. In this fashion, the entire load is transferred to lower holder 100, permitting the drill pipe that has been pulled up above holder 100 to be detached from the landing string, as would appear in FIG. 10. The removed joints of drill pipe would then be cleared from the upper holder and placed on the drilling rig, permitting upper holder 200 to be lowered again so that more joints of drill pipe could be pulled up, as this process is repeated over and over again until all of the landing string and the items attached thereto have been retrieved.

Figure 4:
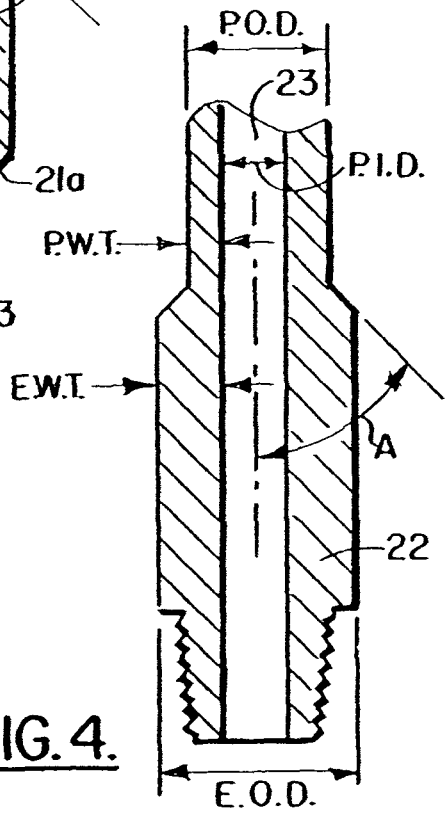

As shown in FIGS. 2-4, drill pipe 18 of the present invention has the following exemplary dimensions:

The end outside diameter (E.O.D.) of pin end 22 and box end 20 is preferably in the range between about 6½ to 9⅞ inches, and most preferably between 7½ and 9 inches.

The end wall thickness (E.W.T.) of pin end 22 and box end 20 is preferably in the range between about 1½ to 3 inches, and most preferably between 1⅞ and 2½ inches.

The pipe inside diameter (P.I.D.), i.e., the diameter of the uniform bore or lumen 23 extending throughout the length of drill pipe 18, is preferably in the range between about 2 to 6 inches, and most preferably between 2⅞ and 5 inches.

The pipe wall thickness (P.W.T.), i.e., the thickness of the pipe wall throughout the length of drill pipe 18, except at the ends and at the enlarged diameter section, is preferably in the range between about ⅝ to 2 inches, and most preferably between ⅞ and 1½ inches.

The pipe outside diameter (P.O.D.), i.e., the outside diameter of drill pipe 18 throughout its length, except at the ends and at enlarged diameter section 21, is preferably in the range between about 4½ to 7⅝ inches, and most preferably between 5 and 7 inches.

The enlarged diameter wall thickness (E.D.W.T.), i.e., the thickness of the pipe wall at enlarged diameter section 21, is preferably in the range between about 1½ to 3 inches, and most preferably between 1⅞ and 2½ inches.

The length "L" of drill pipe 18 is preferably in the range between about 28 to 45 feet, and most preferably between 28 and 32 feet. It should be understood that length "L" may be any length that can be accommodated by the vertical distance between the rig floor and the highest point of the rig.

The length of the enlarged diameter section (L. E.) is preferably in the range between about 1 to 60 inches, and most preferably between 6 and 12 inches.

The distance "D" between shoulder 21*a* and shoulder 20*a* is preferably in the range between about 2 to 11 feet, most preferably between 3 to 5 feet. The design criteria for distance "D" include the following: (a) the distance "D" should be sufficient to provide adequate clearance, and thereby avoid entanglement, between the bottom of holder 200 and the top of holder 100 when said holders are in the position depicted in FIG. 16; (b) the distance "D" should also be sufficient to permit insertion and removal of wedge members 206 into and out of the tapered bowl of upper holder 200; and (c) the distance "D" should preferably be such that the uppermost end of the drill pipe being supported by lower holder 100 is a reasonable working height (R.W.H.) above rig floor 9, as shown in FIG. 10, so as to permit rig personnel and/or automated handling equipment to assist in attaching or removing joints of drill pipe to or from said uppermost end.

The angle of taper "A" of shoulders 21*a*, 20*a* and 22*a*, which appear in FIGS. 3 and 4, can be any angle greater than 0° and less than 180°, more preferably between about 18 degrees and about 65 degrees, more preferably between about 45 and about 65 degrees, more preferably between about 47 and about 63 degrees, more preferably between about 49 and about 61 degrees, more preferably between about 51 and about 59 degrees, more preferably between about 53 and about 57 degrees, and most preferably about 55 degrees. The same angle "A" applies to the angle of taper of shoulder 109 of wedge member 106 and shoulder 209 of wedge member 206, as shown in FIG. 6.

As shown in FIGS. 6 and 7, wedge members 106 and 206 of the present invention have the following exemplary dimensions:

The height ("H-1") of the wedge members is preferably in the range of about 5 to 20 inches, and most preferably between 8 and 16 inches.

The distance ("H-2"), i.e., the vertical height of the shoulder of the wedge member, is preferably in the range of about 2 to 10 inches, and most preferably between 3 and 8 inches.

The distance ("H-3") between the bottom of the wedge members and the bottom of shoulders 109, 209 is preferably in the range of about 3 to 10 inches, and most preferably between 4½ and 8 inches.

The top thickness ("T-1") of the wedge members is preferably in the range of about 1 to 8 inches, and most preferably between 2 and 6½ inches.

The thickness ("T-2") of the wedge members at shoulders 109, 209 is preferably in the range of about 1½ to 8½ inches, and most preferably between 2½ and 6½ inches.

The bottom thickness ("T-3") of the wedge members is preferably in the range of about ½ to 6 inches, and most preferably between ¾ and 4 inches.

The angle of taper ("A.T.") of outer face 107, 207 of the wedge members can be any angle greater than 0° and less than 180°, preferably between 10 degrees and 45 degrees.

Figure 14:
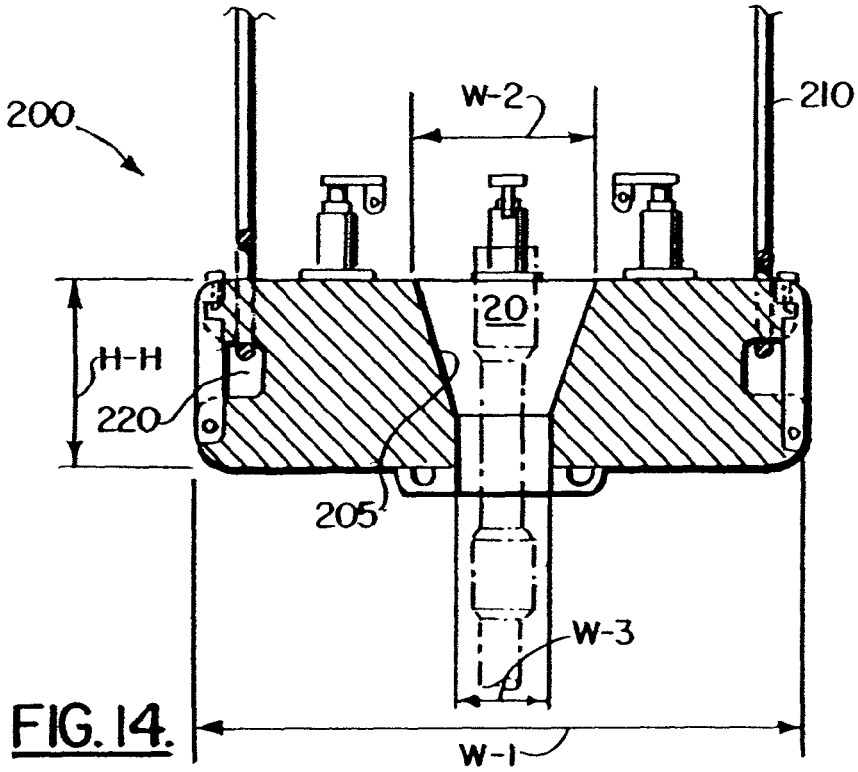
FIG. 14 is a cross sectional view taken along lines 14-14 of FIG. 13.

As shown in FIG. 14, upper holder 200 of the present invention has the following exemplary dimensions:

The height of holder 200 ("H.H.") is preferably in the range of about 18 to 72 inches, and most preferably between 24 and 48 inches.

The width of holder 200 ("W-1") is preferably in the range of about 24 to 72 inches, and most preferably between 36 and 60 inches.

The width of the top of opening 203 ("W-2") of holder 200 is preferably in the range of about 12 to 24 inches, and most preferably between 16 and 21 inches.

The width of the bottom of opening 203 ("W-3") of holder 200 is preferably in the range of about 6 to 18 inches, and most preferably between 9 and 15 inches.

Figure 9:
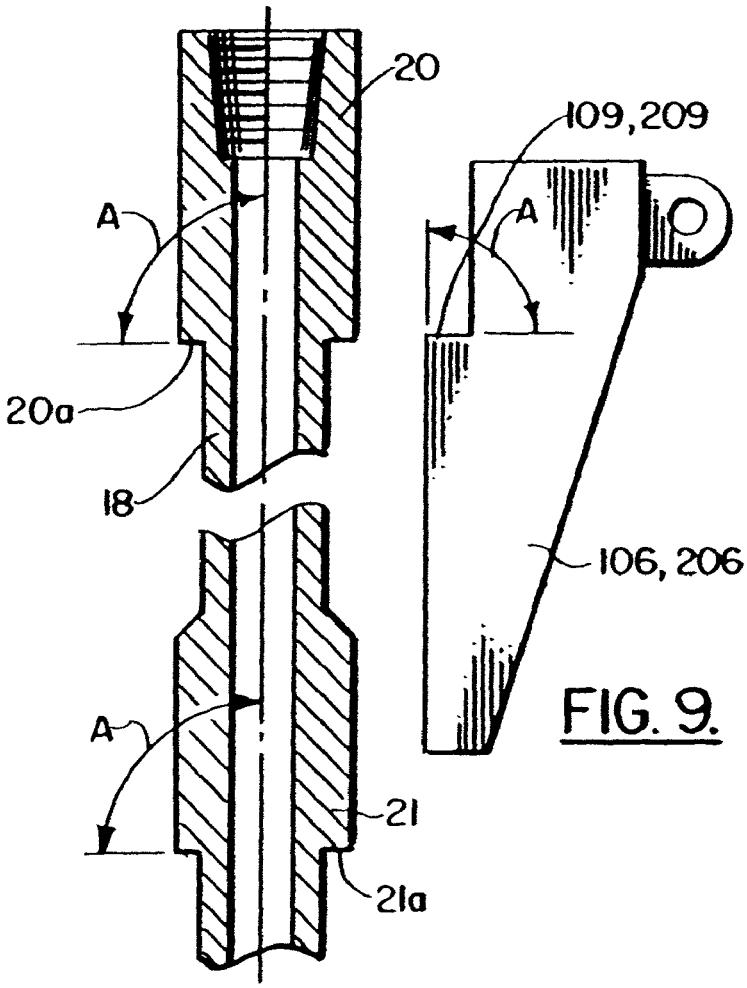
FIG. 9 is a fragmentary, sectional, elevational view of an alternative embodiment of drill pipe in accordance with the present invention, along with a side view of a wedge member used with the alternative embodiment in both the upper and lower holders of the present invention.

FIG. 9 depicts an alternative embodiment of the present invention wherein the shoulders, for example shoulders 21*a* and 20*a*, are square, i.e., wherein angle "A" measures 90 degrees. In that alternative embodiment as depicted in FIG. 9, the shoulders 109 and 209, respectively, of wedge members 106 and 206, respectively, are also square.

In the embodiment of the invention as depicted in FIG. 12, wedge members 106 are lifted out of position by a lifting apparatus which includes lifting arms 112. Lifting arms 112 may be raised and lowered by way of an actuator 114, preferably a pneumatic or hydraulic piston-cylinder arrangement. Lifting arms 112 may be attached directly to wedge members 106 or via connectors 111 as shown in FIG. 12. Connectors 111 may be cables, links, bails, slings or other mechanical devices which serve to connect lifting arms 112 to wedge members 106. Wedge members 106 preferably include lifting eye 115 to facilitate the connection to lifting arms 112. It should be understood that the raising and lowering wedges 106 out of and into position in body 104 can be accomplished in a variety of ways, including manual handling by rig personnel. It should also be understood that the lifting apparatus for raising and lowering wedge members 106 must be sized and configured so as to permit sufficient clearance for upper holder 200 when it is in the position shown in FIGS. 15 and 16.

As depicted in FIGS. 11 and 12, upper holder 200 preferably includes a lifting apparatus for raising and lowering wedge members 206 out of and into position in main body 204. In the embodiment of the invention as depicted in FIG. 12, the lifting apparatus includes lifting arms 212. Lifting arms 212 may be moved up and down by actuator 214, preferably a hydraulic or pneumatic piston-cylinder arrangement. Lifting arms 212 may be attached directly to wedge members 206 or via connectors 211. Connector 211 may be cables, links, bails, slings or other mechanical devices which serve to connect lifting arms 212 to wedge members 206. Wedge members 206 preferably include lifting eyes 215 to facilitate the connection to lifting arms 212.

In the embodiment of the invention as shown in FIG. 13, upper holder 200 is removably attached to elevator links 210. Main body 204 of upper holder 200 is preferably comprised of steel having recessed areas 220 to accommodate therein placement of elevator link eyes 221. Elevator link eyes 221 are retained in the position shown in FIGS. 13 and 14 by link retainers 222. Link retainers 222 may be moved from the closed position shown in FIG. 14 to an open position by lifting release pins 224, thereby permitting retainer links 222 to pivot about hinge pin 225 to an open position, thus permitting removal of upper holder 200 from elevator links 210. As best depicted in FIG. 12, upper holder 200 is also provided with lifting eyes 230 to which connectors 301 may be attached.

Figure 17:
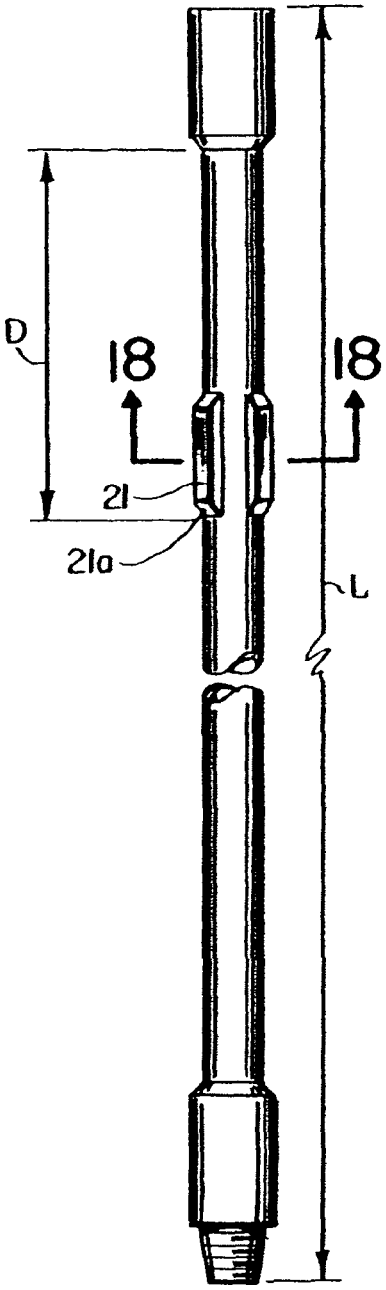
FIG. 17 is an elevational view of an alternative embodiment of the drill pipe in accordance with the present invention.
Figure 18:
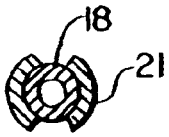
FIG. 18 is a cross sectional view taken along lines 18-18 of FIG. 17.

FIGS. 17 and 18 depict an alternative embodiment of the present invention in which enlarged diameter section 21 is not enlarged completely around the circumference of drill pipe 18. In this alternative embodiment of enlarged diameter section 21, shown in cross section in FIG. 18, there may be one or more cross sectional gaps in section 21 where the diameter is not enlarged.

In the preferred embodiment of the invention, drill pipe 18, including box end 20, enlarged diameter section 21 and pin end 22, is made from a single piece of pipe of uniform wall thickness having the dimension E.W.T. in FIG. 4, said thickness being reduced at intervals along the pipe by milling between box end 20 and enlarged diameter section 21, and by milling between pin end 22 and enlarged diameter section 21. It should be understood that in such preferred embodiment of the invention, box and pin ends 20 and 22 and enlarged diameter section 21 are integral with the pipe, i.e., box end 20 and pin end 22 are not created by welding or otherwise attaching said ends to drill pipe 18, nor is enlarged diameter section 21 created through welding or other means of attachment. In the preferred embodiment of the invention, each joint of drill pipe 18 is made of steel and weighs between 800 to 5,000 pounds, most preferably between 1,000 to 2,000 pounds, or approximately 29 to 110 pounds per linear foot, most preferably 32 to 75 pounds per linear foot.

Alternatively, drill pipe 18 of the present invention may be made of a piece of pipe of uniform thickness, referenced as P.W.T. in FIG. 4, with attached box and pin ends, and with an attached enlarged diameter section 21. In this alternative embodiment, the box end, pin end and enlarged diameter section may be attached to the pipe by welding, bolting or other means.

In a further alternative embodiment of the present invention, drill pipe 18 may be made from titanium or from a carbon graphite composite.

Figure 19:
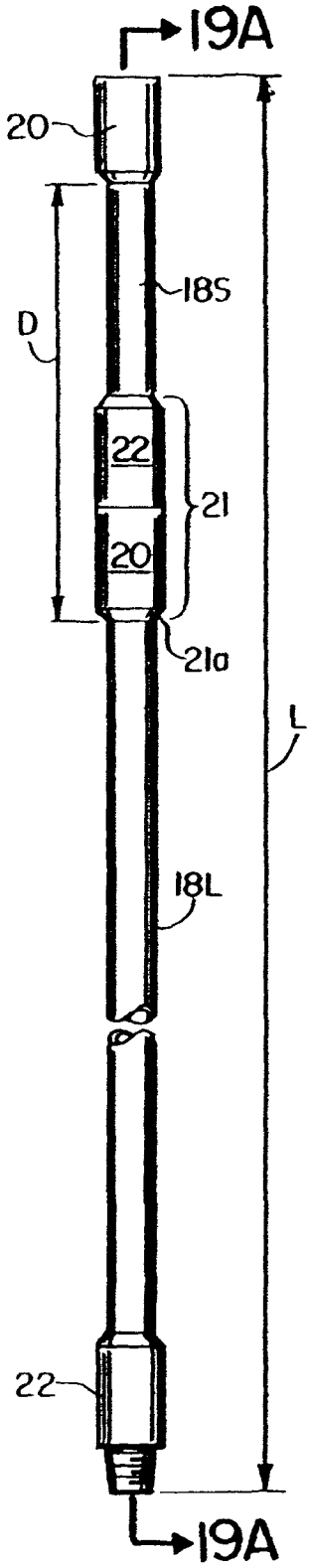
FIG. 19 is an elevational view of an alternative embodiment of drill pipe in accordance with the present invention.
Figure 19A:
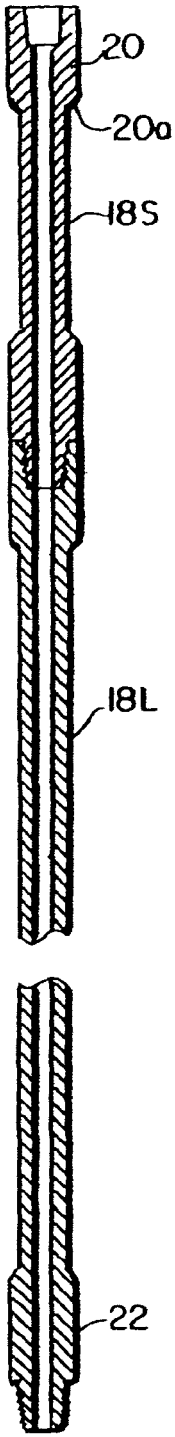
FIG. 19A is a cross sectional view taken along lines 19A-19A of FIG. 19.
Figure 21:
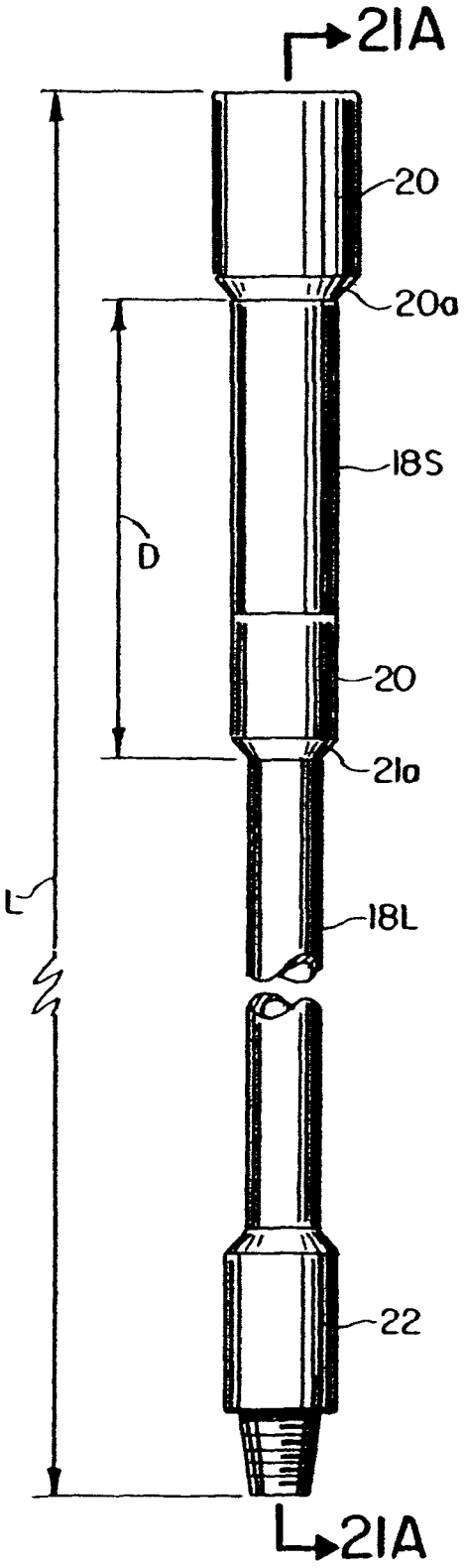
FIG. 21 is an elevation view of another alternative embodiment of drill pipe in accordance with the present invention.
Figure 21A:
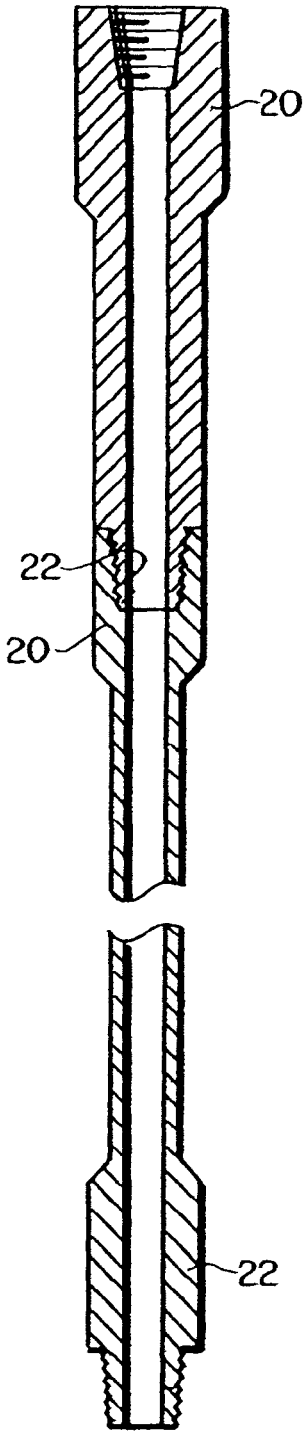
FIG. 21A is a cross sectional view taken along lines 21A-21A of FIG. 21.

FIGS. 19 and 21 show further alternative embodiments of the present invention in which drill pipe 18, having a length "L", is comprised of two separate drill pipes, 18S and 18L, the former being shorter than the latter, each one having a female end 20 and a male end 22. As shown in FIGS. 19 and 21, 18S is attached end-to-end with 18L. In the alternative embodiment depicted in FIG. 19, the mated male end 22 and female end 20 combine to form enlarged diameter section 21, having a tapered shoulder 21*a* defined by the tapered shoulder of mated female end 20. In the alternative embodiment depicted in FIG. 21, the mated female end 20 serves as enlarged diameter section 21, with the shoulder of said mated female end serving as shoulder 21*a*.

Figure 22:
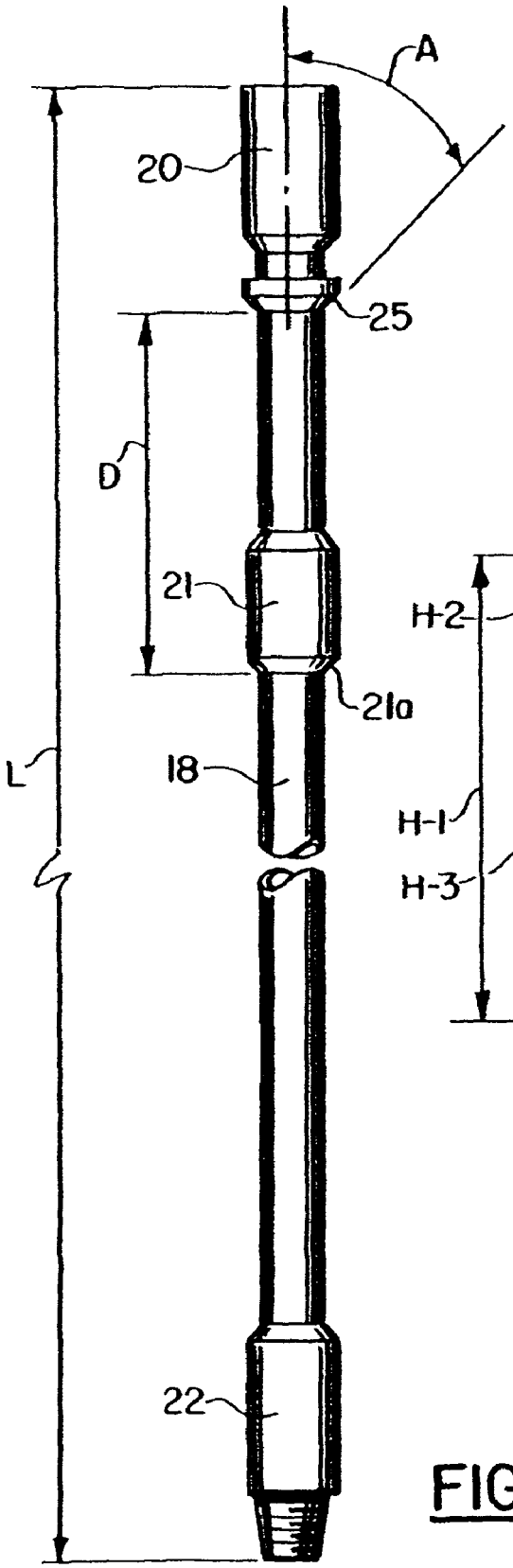
FIG. 22 is an elevation view of yet another alternative embodiment of the present invention.

In yet a further alternative embodiment of the present invention shown in FIG. 22, an extra tapered shoulder 25 is provided on drill pipe 18 between enlarged diameter section 21 and the end of the drill pipe. In this embodiment of the invention, extra tapered shoulder 25 has an angle of taper "A" that corresponds with and is engaged by shoulder 209 of wedge members 206, thereby providing support for the drill pipe being held by upper holder 200. In this embodiment, "D" is the distance between shoulder 21*a* and shoulder 25.

The distance "D", the angle "A" and the length "L" in the alternative embodiment shown in FIGS. 17, 19, 21 and 22 are comparable to those of the preferred embodiment as shown in FIG. 3.

Figure 23:
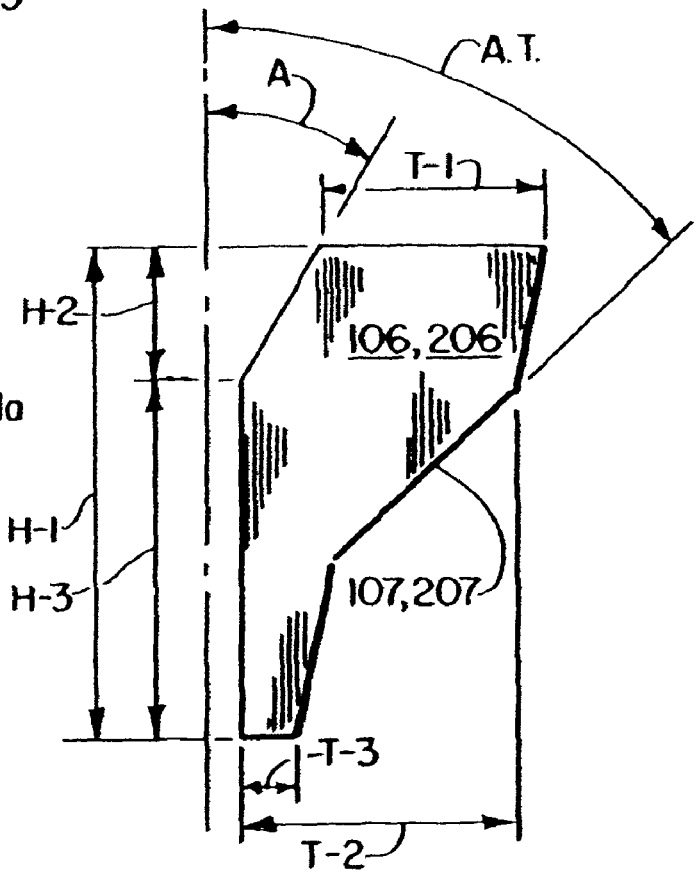
FIG. 23 is an elevational side view of a second embodiment of wedge members in accordance with the present invention.

FIG. 23 depicts a second embodiment of wedge members 106, 206 in accordance with the present invention. The dimensions H-1, H-2, H-3, T-1, T-2 and T-3, and the angles A and A.T. in the embodiment shown in FIG. 23 are comparable to those of the embodiment as shown in FIG. 6.

Figure 20:
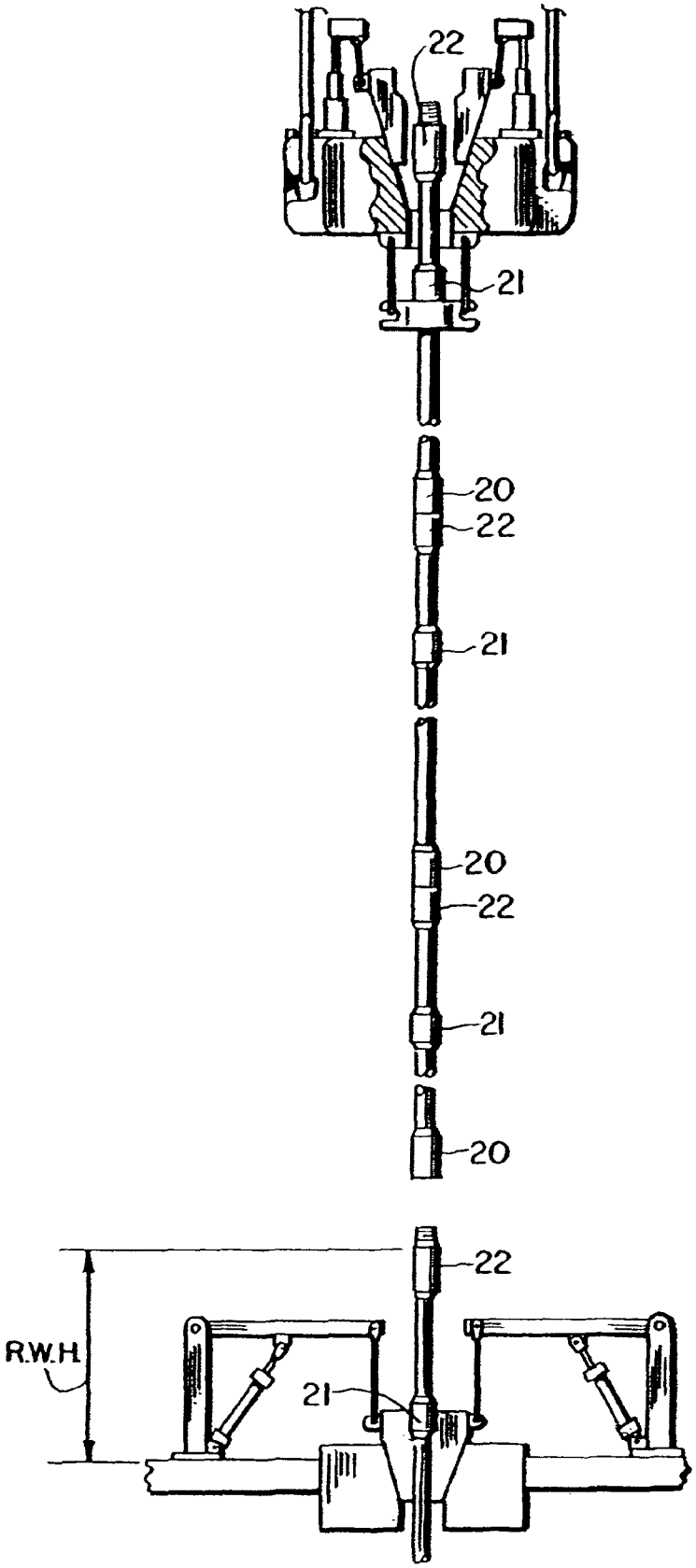
FIG. 20 is an elevational view of an alternative embodiment of the present invention in which the joints are run with the female end down and the male end up.

It should be understood that in an alternative embodiment of the present invention, the drill pipe may be run with the male or pin end 22 up and the female or box end 20 down, as depicted in FIG. 20. In this alternative embodiment of the invention, tapered shoulder 209 of wedge member 206 corresponds with tapered shoulder 22*a* of pin end 22 of drill pipe 18; shoulder 209 is curved to correspond with and accommodate the curved, circumferential shape of shoulder 22*a*; and curved surface 206*b* of wedge member 206 corresponds with and accommodates the curved outer surface 22*b* of drill pipe 18.

Crossover connection 36 depicted in FIG. 1 may include an "SB" Casing Hanger Running Tool in conjunction with an "SB" Casing Hanger, all manufactured by Kvaerner National Oilfield Products.

Figure 24:
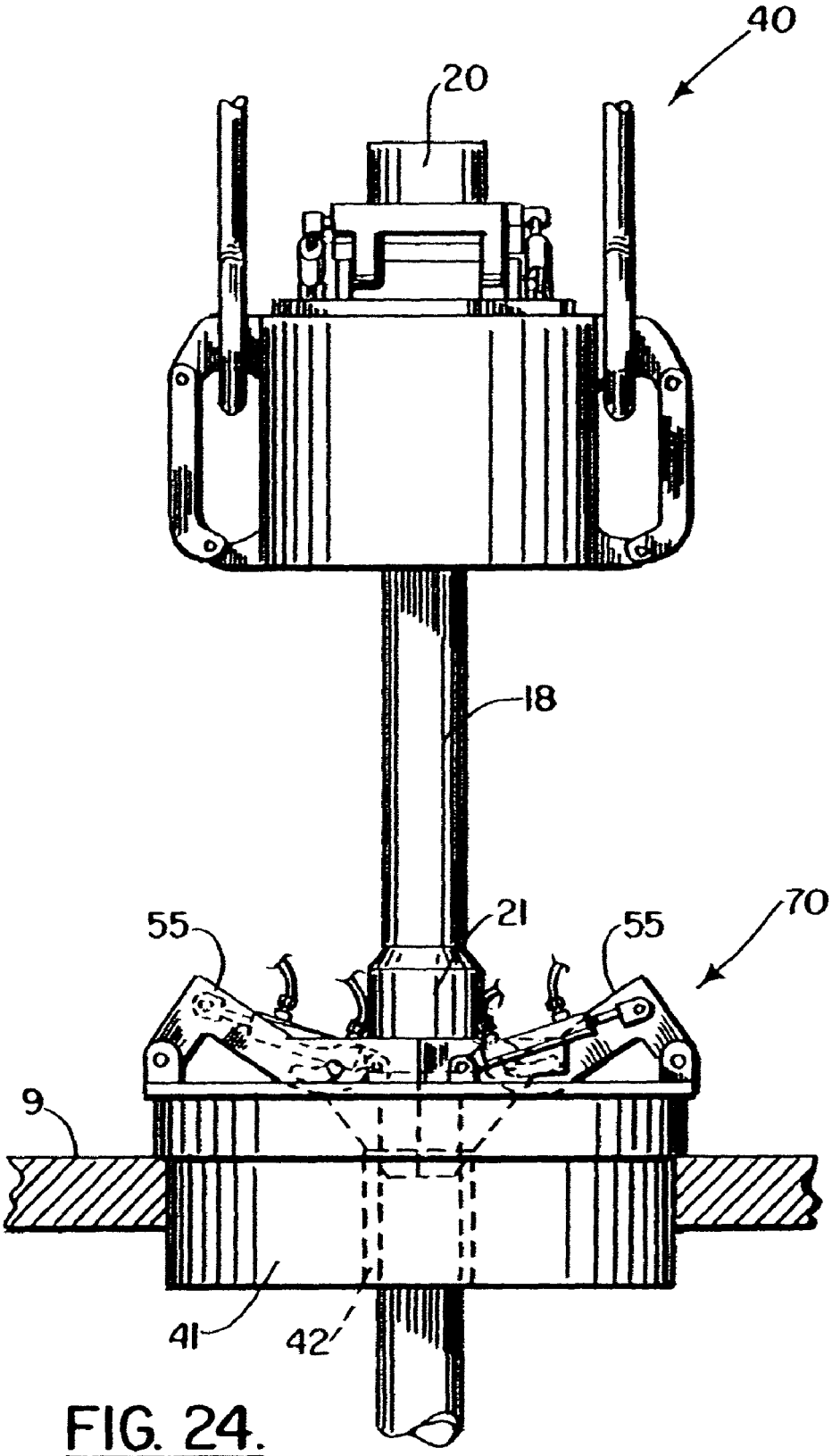
FIG. 24 is an elevational view of the preferred embodiment of the upper and lower holders in accordance with the present invention.

FIGS. 24-29 show the preferred embodiment of the apparatus of the present invention in which the upper and lower holders shown and described with respect to FIGS. 10-16 and 20 are replaced by preferred constructions for the upper and lower holders. In FIG. 24, the preferred embodiment for the upper holder is designated generally by the numeral 40. In FIG. 24, the preferred embodiment for the lower holder is designated by the numeral 70. The lower holder 70 is shown in more detail in FIGS. 25, 25A, 26 and 27. The upper holder 40 is shown in more detail in FIGS. 28 and 29.

In FIGS. 24-27, lower holder 70 includes a main body 41 having a cylindrically shaped bore 42 extending to the lower surface 41A of body 41 and a frustoconically shaped tapered face 43 extending to the upper surface 41B of body 41. A pair of wedge members 44 can be inserted (FIG. 25A) or removed (FIGS. 25 and 27) from the main body 41. Each of the wedge members 44 has an outer tapered face 45 that is of a corresponding shape to the tapered face 43 of main body 41. Wedge members 44 are movable with respect to main body 41 between engaged and disengaged positions. When wedge members 44 are in place in main body 41 of lower holder 70, as shown in FIG. 25A, said wedge members 44 form an interface between body 41 and the joint of drill pipe 18 being held by lower holder 70, the engagement between shoulder 62 of wedge member 44 and shoulder 21*a* of enlarged diameter section 21 providing support for the drill pipe 18 being held by the holder 70.

In order to move the wedge members 44 in to the engaged position (FIG. 25A), and out to the disengaged position (FIG. 25), one or more actuators such hydraulic cylinders 50 can be provided. The hydraulic cylinders 50 each have opposing end portions and are preferably attached at one end portion to main body 41. At an opposing end portion, each hydraulic cylinder 50 may be attached pivotally to a lifting arm 55 of each wedge member 44.

Figure 25:
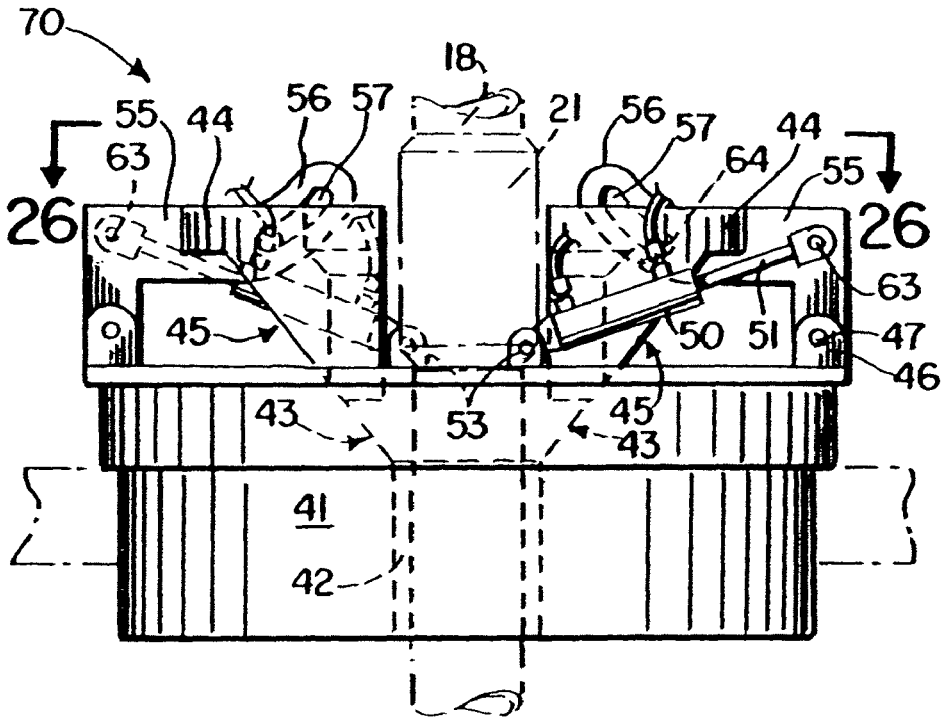
FIG. 25 is a fragmentary elevational view of the preferred embodiment of the lower holder of the present invention showing the wedge members of the lower holder in a disengaged or removed position.
Figure 25A:
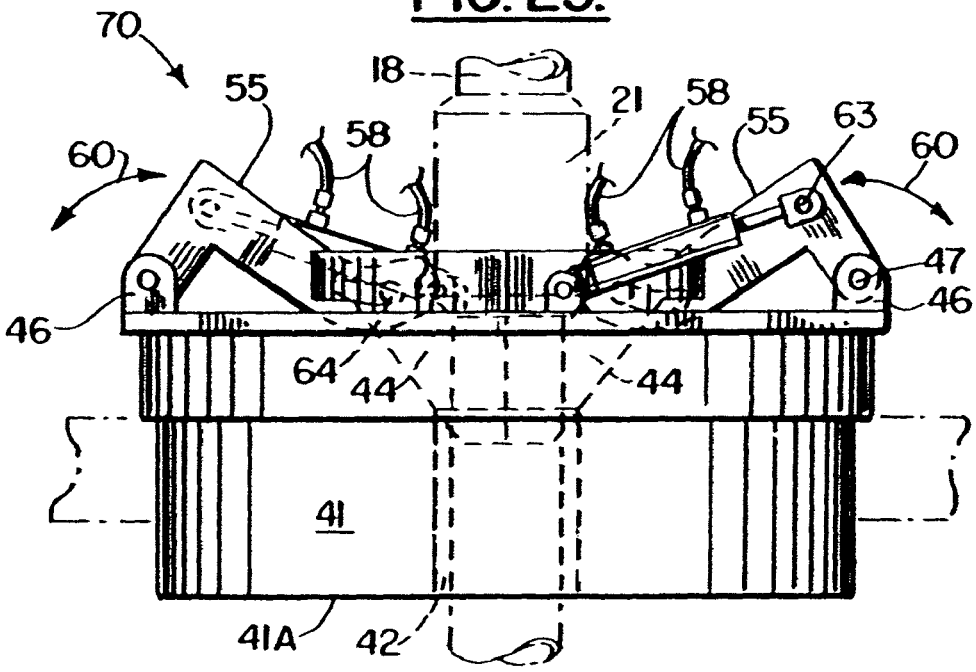
FIG. 25A is a fragmentary elevational view of the preferred embodiment of the lower holder of the present invention showing the wedge members of the lower holder in an engaged position.
Figure 26:
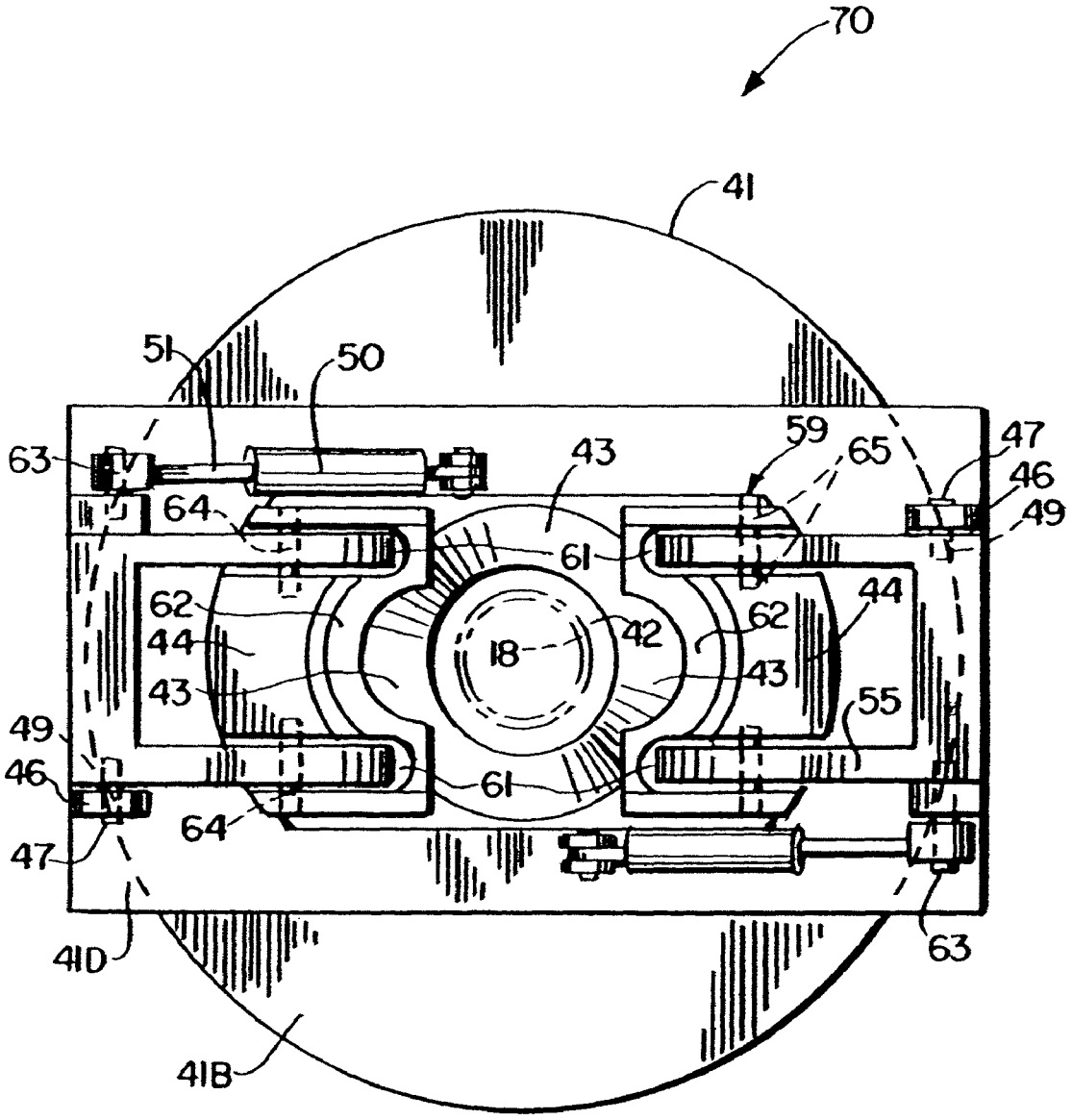
FIG. 26 is a plan view taken along lines 26-26 of FIG. 25.
Figure 27:
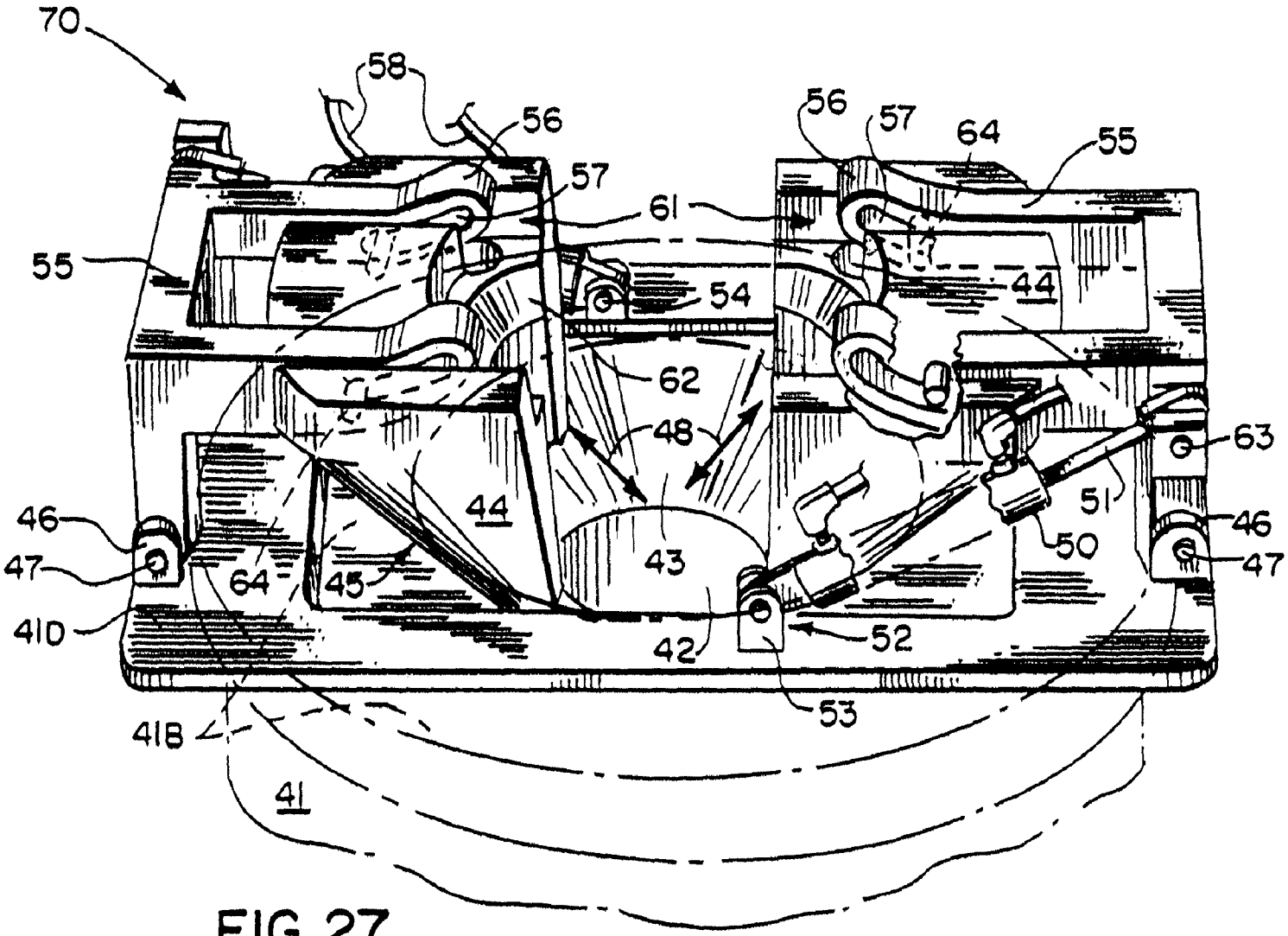
FIG. 27 is a partial perspective view of the preferred embodiment of the lower holder of the present invention showing the wedge members of the lower holder in a removed position.

As shown in FIGS. 26-27, there are preferably two lifting arms 55, one for each wedge member 44, and preferably two hydraulic cylinders 50, one for each lifting arm 55. The lifting arms 55 may be pivotally attached to main body 41. Body 41 preferably includes a mounting plate 41D, best shown in FIGS. 26 and 27, which facilitates placement and attachment of lifting arms 55 to body 41. As shown in FIGS. 25, 25A, 26 and 27, each lifting arm 55 can be pivotally attached at padeyes 46 to main body 41. This pivotal connection can be achieved using a pivot pin 47 or pinned connection that extends through the padeye 46 and into socket 49 provided in the lifting arms 55, as best shown in FIG. 26. Arrows 48 in FIG. 27 schematically illustrate the movement of wedge members 44 between the engaged, pipe holding position of FIG. 25A and the disengaged position of FIG. 25.

Each hydraulic cylinder 50 may be pivotally attached with a pivotal connection 52 to main body 41. Pivotal connection 52 preferably includes padeyes 53 on main body 41 which receive an end portion of hydraulic cylinder 50, and pin 54, as best shown in FIGS. 26 and 27.

A pivotal connection 63 can be provided between each pushrod 51 of cylinder 50 and an arm 55 as shown in FIGS. 25, 25A, 26 and 27. The pivotal connection 63 is spaced from the pivotal connection at pin 47, as best shown in FIGS. 25 and 25A. The hydraulic cylinder 50 can be filled with hydraulic fluid transmitted via flowlines 58, causing the pushrod to extend as shown in FIGS. 25, 26 and 27, or to retract as shown in FIG. 25A. When the pushrod is moved from its retracted position of FIG. 25A to its extended position of FIG. 25, pushrod 51 rotates its connected lifting arm 55 about pivot pin 47 as schematically indicated by the arrows 60 in FIG. 25A.

Pinned connections 59 can be provided for connecting each of the wedge members 44 to a lifting arm 55, as shown in FIG. 26. Each lifting arm 55 preferably has two, curved free-end portions 56, each such free-end portion 56 having a curved slot 57, as best shown in FIGS. 25 and 27. The curved free-end portion 56 and slot 57 of each lifting arm 55 are so configured that when the lifting arms 55 are lowered to the position shown in FIG. 25A, the wedge members 44 closely conform to the drill string 18. In this position (FIG. 25A), shoulder 62 provided on each of the wedge members 44 is configured to receive a correspondingly shaped shoulder on the drill pipe 18 being held by holder 70, such as the annular shoulder 21*a* on the enlarged diameter section 21 of the drill pipe 18 that is shown in FIG. 2.

Each wedge member 44 preferably has an accommodating recess 61 for each curved free end 56 of lifting arm 55, as shown in FIGS. 26 and 27. Each pinned connection 59 joins each curved free end 56 at slot 57 to a wedge member 44. Each pinned connection 59 preferably includes a pin member 64 that extends through curved free end 56 and into socket 65 on wedge members 44. In the engaged position of FIG. 25A, the pin member 64 locates at an end portion of slot 57 closest to drill pipe 18. In the disengaged position of FIG. 25, the pin member 64 locates at an end portion of slot 57 furthest away from drill pipe 18.

Figure 29:
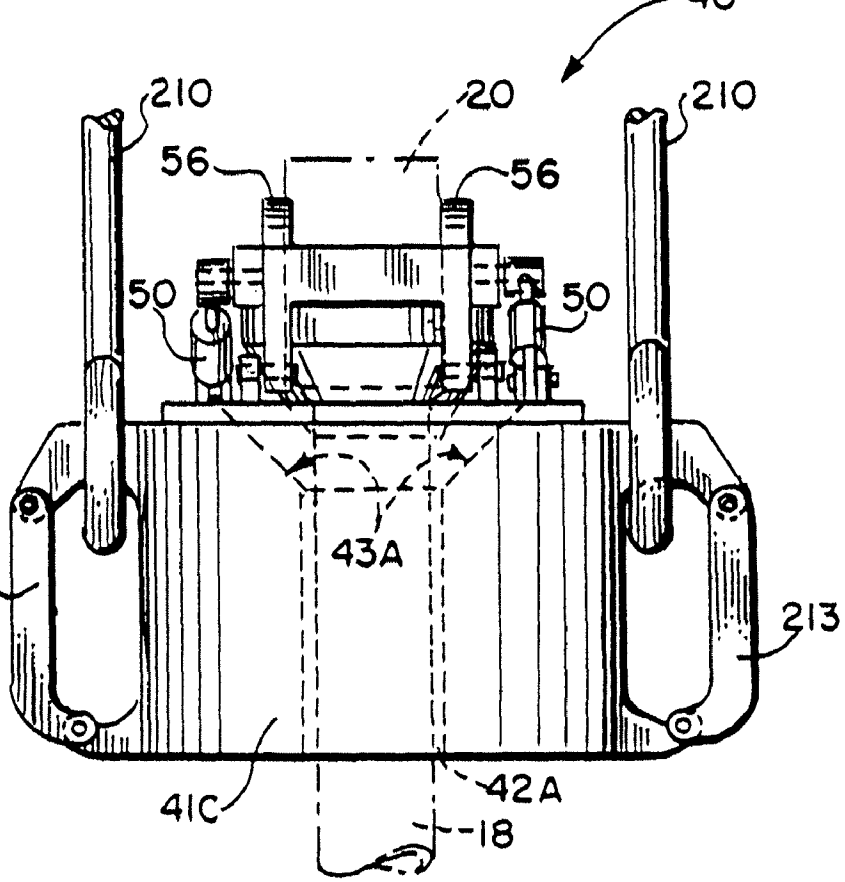
FIG. 29 is an elevation view taken along lines 29-29 of FIG. 28.
Figure 28:
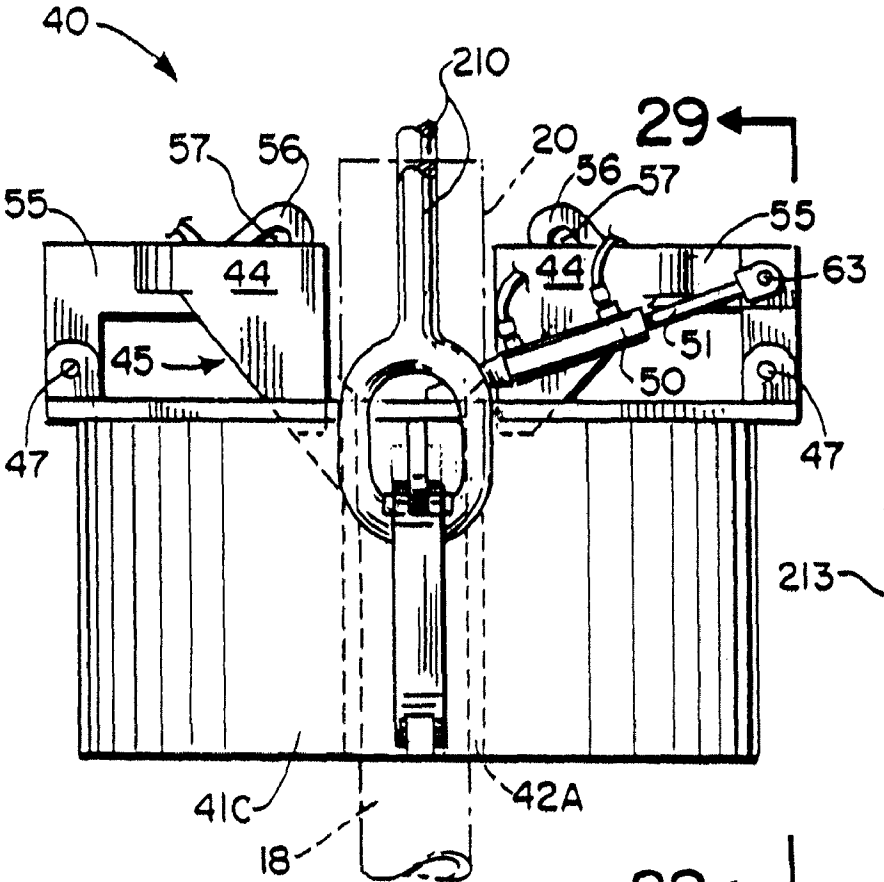
FIG. 28 is a partial elevational view of the preferred embodiment of the upper holder of the present invention showing the wedge members of the upper holder in a disengaged position.

The preferred embodiment of upper holder 40 is shown in FIGS. 24, 28, 29. Upper holder 40 has main body 41C with a vertical, open-ended bore that preferably includes cylindrically shaped section 42A and frustoconically shaped tapered face 43A. As with lower holder 70, upper holder 40 has wedge members 44 that hold the drill pipe 18 by engaging a shoulder on each wedge member with a shoulder on the drill pipe 18 being held by upper holder 40.

The wedge members 44 of upper holder 40 are preferably moved between engaged and disengaged positions using the same mechanism provided for the lower holder 70 as shown in FIGS. 24-27 and as described herein. Thus, the upper holder 40 preferably has the same wedge members 44, hydraulic cylinders 50 and lifting arms 55 as the lower holder 70, including all of the structure shown in FIGS. 24-27. The tapered face 43A of main body 41C of upper holder 40, similar to tapered face 43 of lower holder 70, receives tapered outer faces 45 of wedge members 44. The upper holder 40 preferably differs from the lower holder 70 in that the upper holder 40 may also have lifting means, such as lifting eyes 213, that enable main body 41C to be lifted by elevator links 210.

Figure 34:
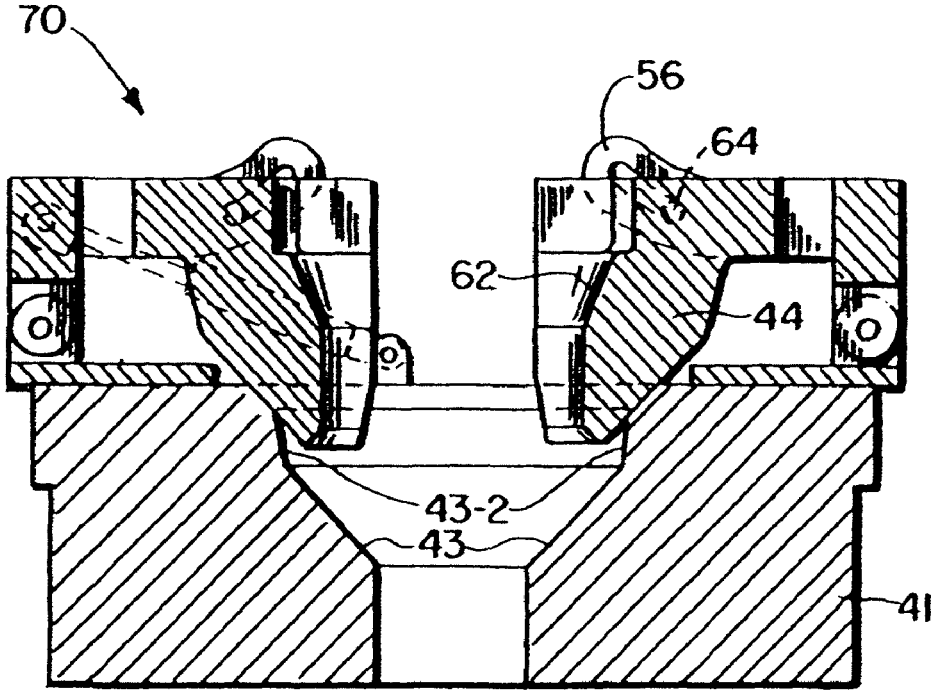
FIG. 34 is an elevational view of a cross section taken through the center of the lower holder, showing the preferred embodiment of the wedge members in accordance with the present invention, with the wedge members in a disengaged position.
Figure 35:
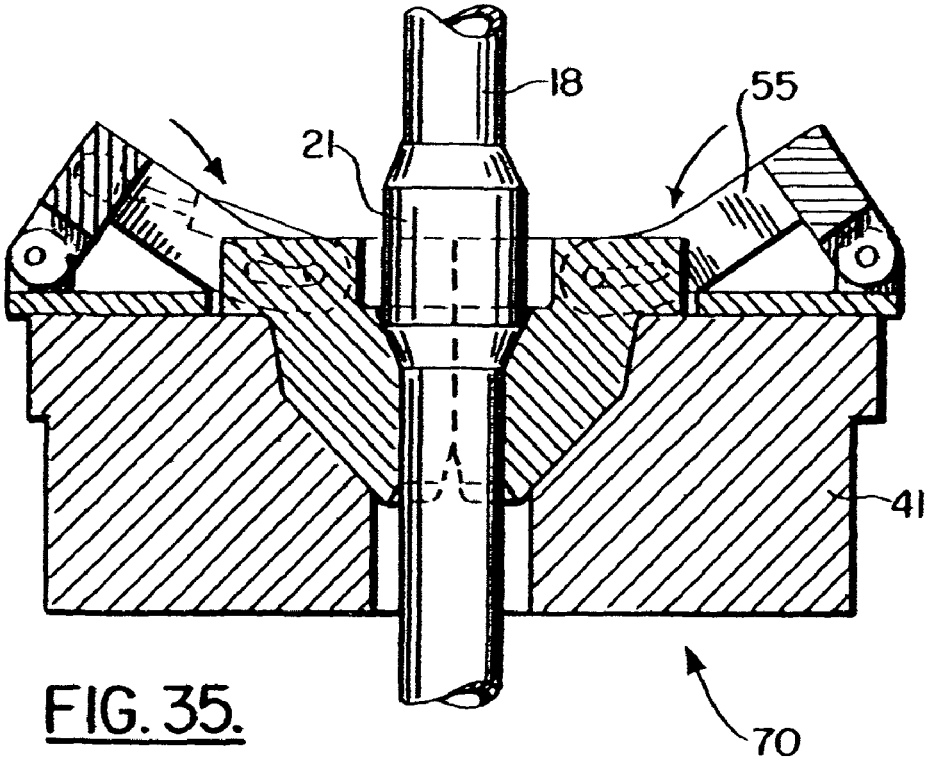
FIG. 35 is an elevational view of a cross section taken through the center of the lower holder, showing the preferred embodiment of the wedge members in accordance with the present invention, with the wedge members in an engaged position about the drill pipe.
Figure 36:
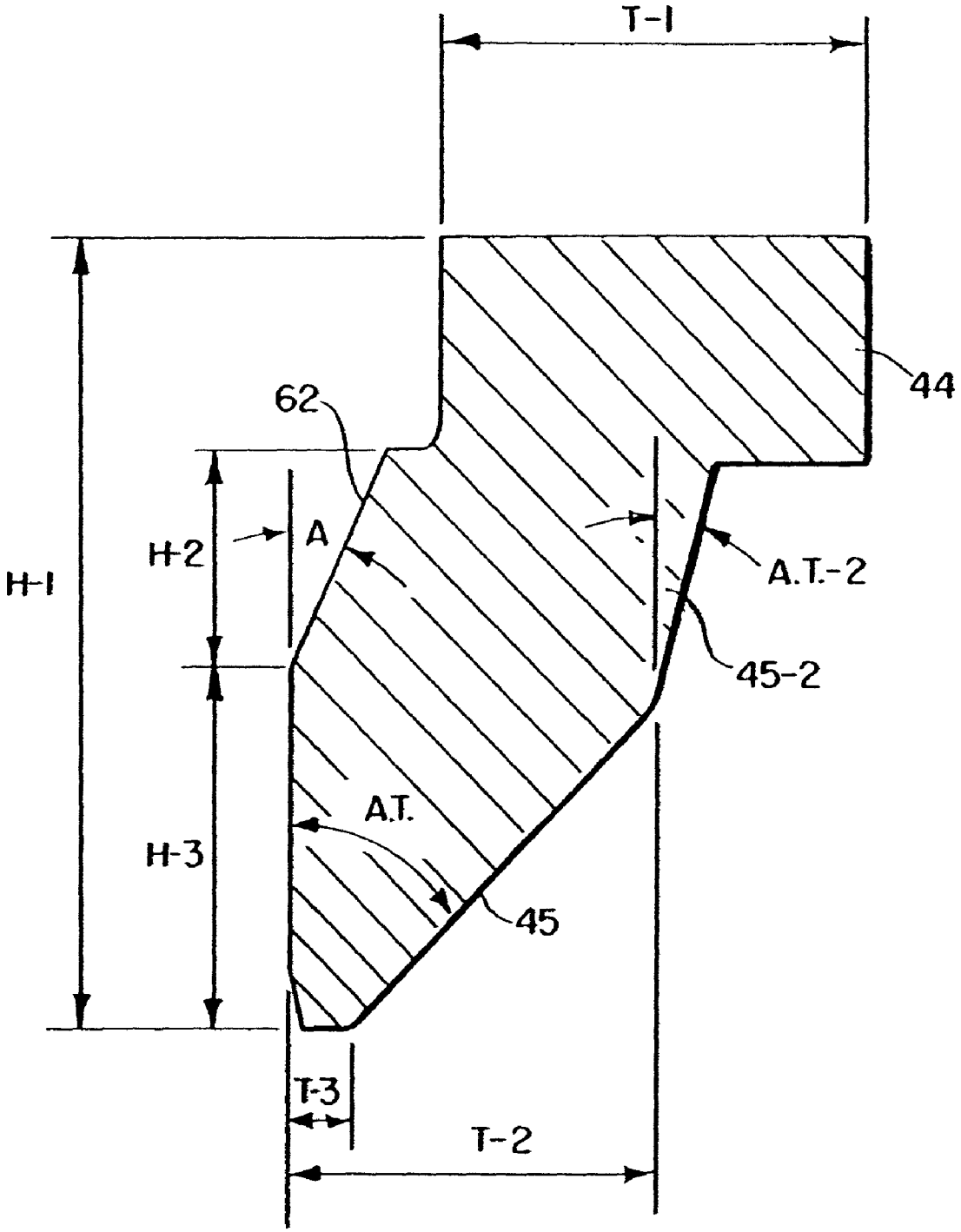
FIG. 36 is an elevational view of the cross section of the preferred embodiment of the wedge members shown in FIGS. 34 and 35.

The preferred embodiment of wedge members 44 is depicted in FIGS. 34-36. The configuration and shape of wedge members 44 of lower holder 70 are similar to that of wedge members 44 of upper holder 40, although there may be slight variations in size and/or dimensions of such wedge members. The dimensions H-1, H-2, H-3, T-1, T-2 and T-3, and the angles A and A.T. in the preferred embodiment shown in FIGS. 34-36 are comparable to those of the embodiments shown in FIGS. 23 and 6, with preferred dimensions as follows: H-1 is 11 inches; H-2 is 3.08 inches; H-3 is 4.92 inches; T-1 is 6.465 inches; T-2 is 4.87 inches; T-3 is 0.84 inches; and A is 55°.

The preferred embodiment of the wedge members shown in FIGS. 34 through 36, in addition to having tapered outer face 45 with a preferred angle of taper (A.T.) of 45°, also has a second tapered outer face 45-2 with a preferred angle of taper (A.T.-2) of 9.5°. As shown in FIGS. 34 and 35, main body 41 preferably includes a second tapered face 43-2 which corresponds to and accommodates second tapered outer face 45-2 of wedge member 44. Second tapered faces 45-2 and 43-2 serve to help guide the wedge members into main body 41 when the wedge members are being placed into their engaged position. Second tapered faces 45-2 and 43-2 also help to prevent the wedge members from becoming lodged or "stuck" in main body 41, thereby facilitating movement of the wedge members from the engaged to the disengaged position.

When lowering or raising a landing string to or from the sea floor, it is sometimes desirable to simultaneously lower or raise a conduit or "umbilical cord" 80 along with and on the outside of the drill pipe 18 as shown in FIGS. 30 through 32 and FIGS. 37 through 39. Umbilical cord 80 typically includes items such as hydraulic lines, electrical wires and/or miscellaneous cables. To accommodate such an umbilical cord 80, lower holder 70 may be provided with an umbilical cord clearance or groove 82, as depicted in the embodiment of the lower holder 70 shown in FIGS. 30-33 and FIGS. 37-39.

Figure 30:
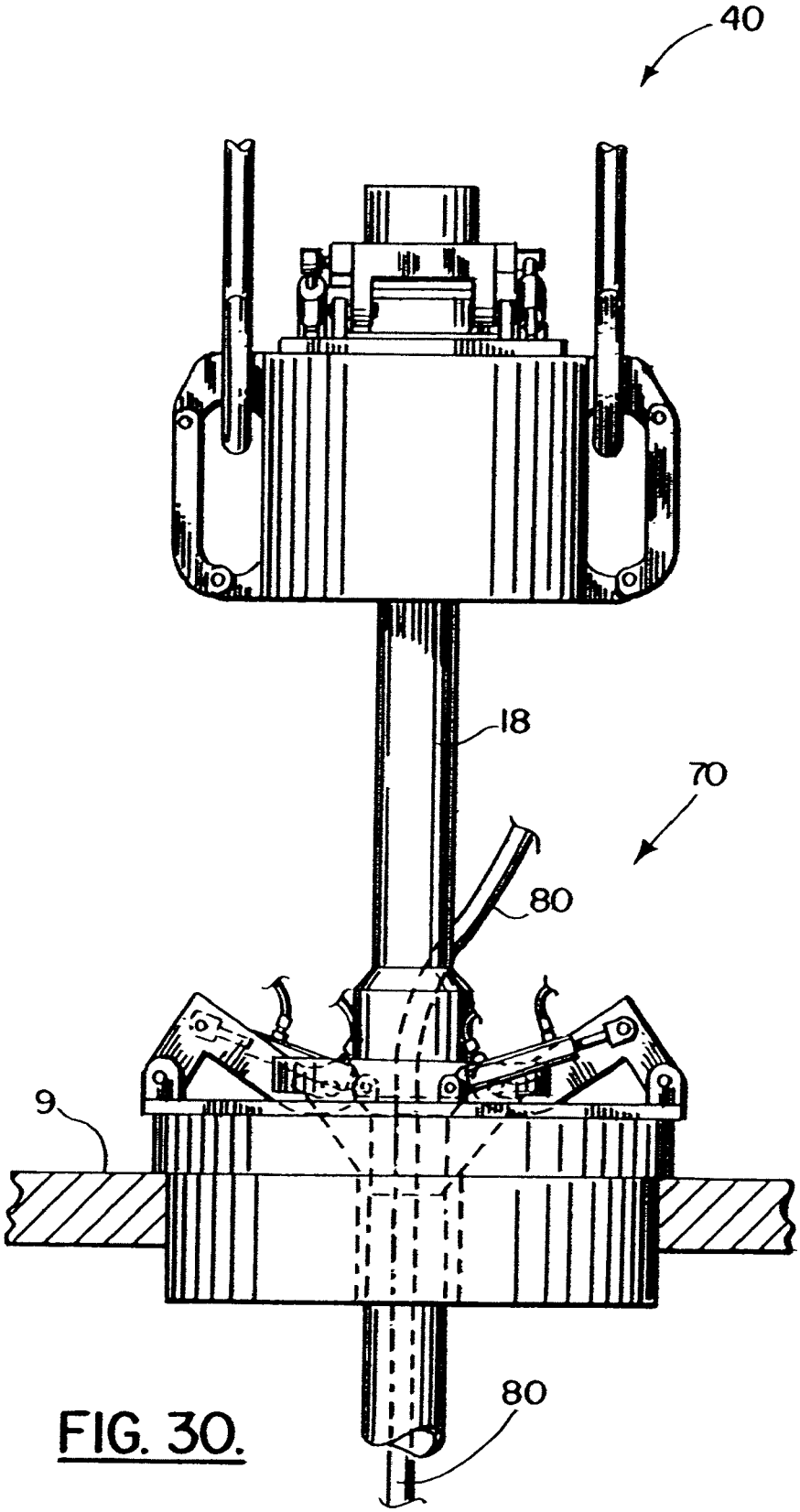
FIGS. 30 through 33 depict a further alternative embodiment of the apparatus of the present invention showing a conduit or umbilical cord running along the outside of the drill pipe wherein said conduit is accommodated by a groove in the lower holder, but which in all other respects corresponds to the views shown in FIGS. 24 through 27, respectively.
Figure 31:
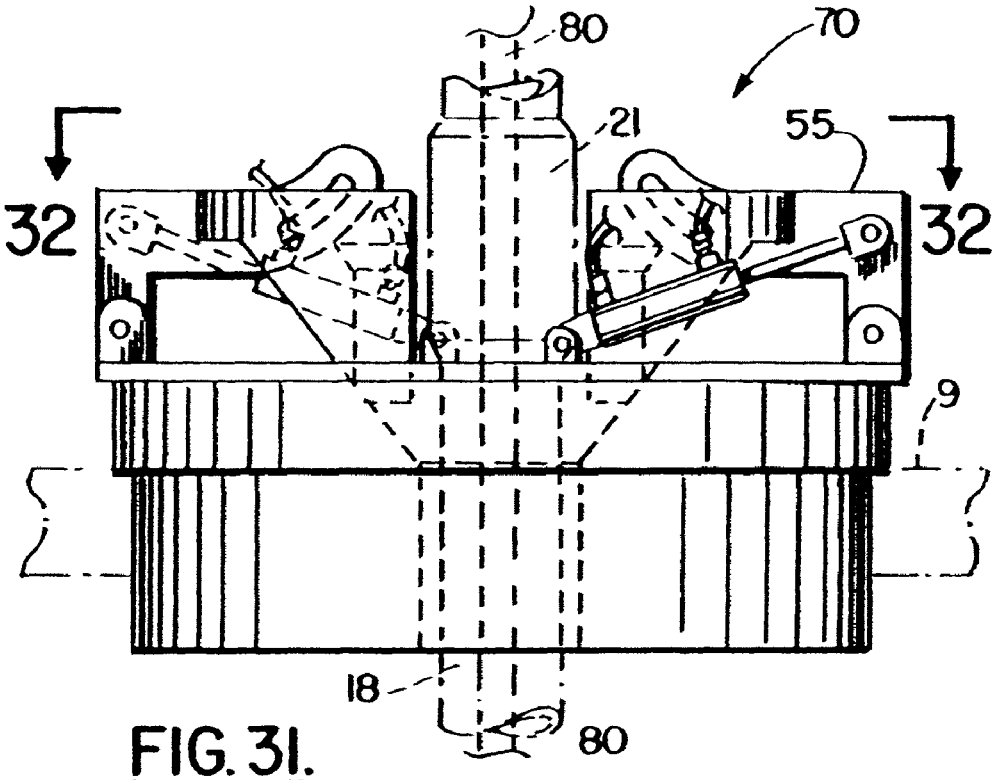
Figure 31A:
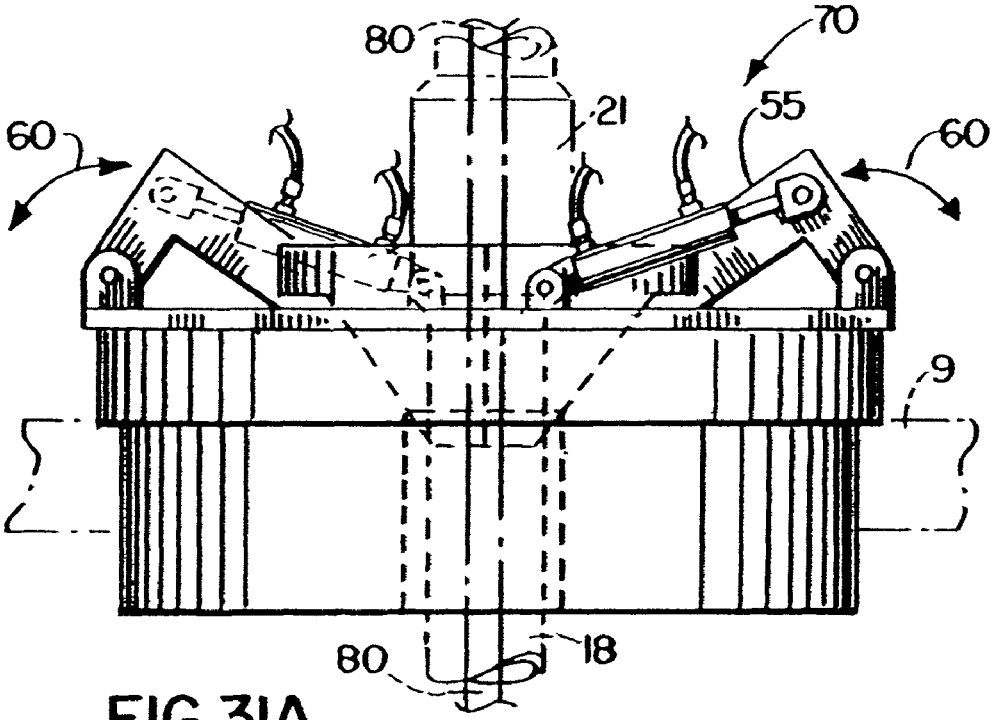
Figure 32:
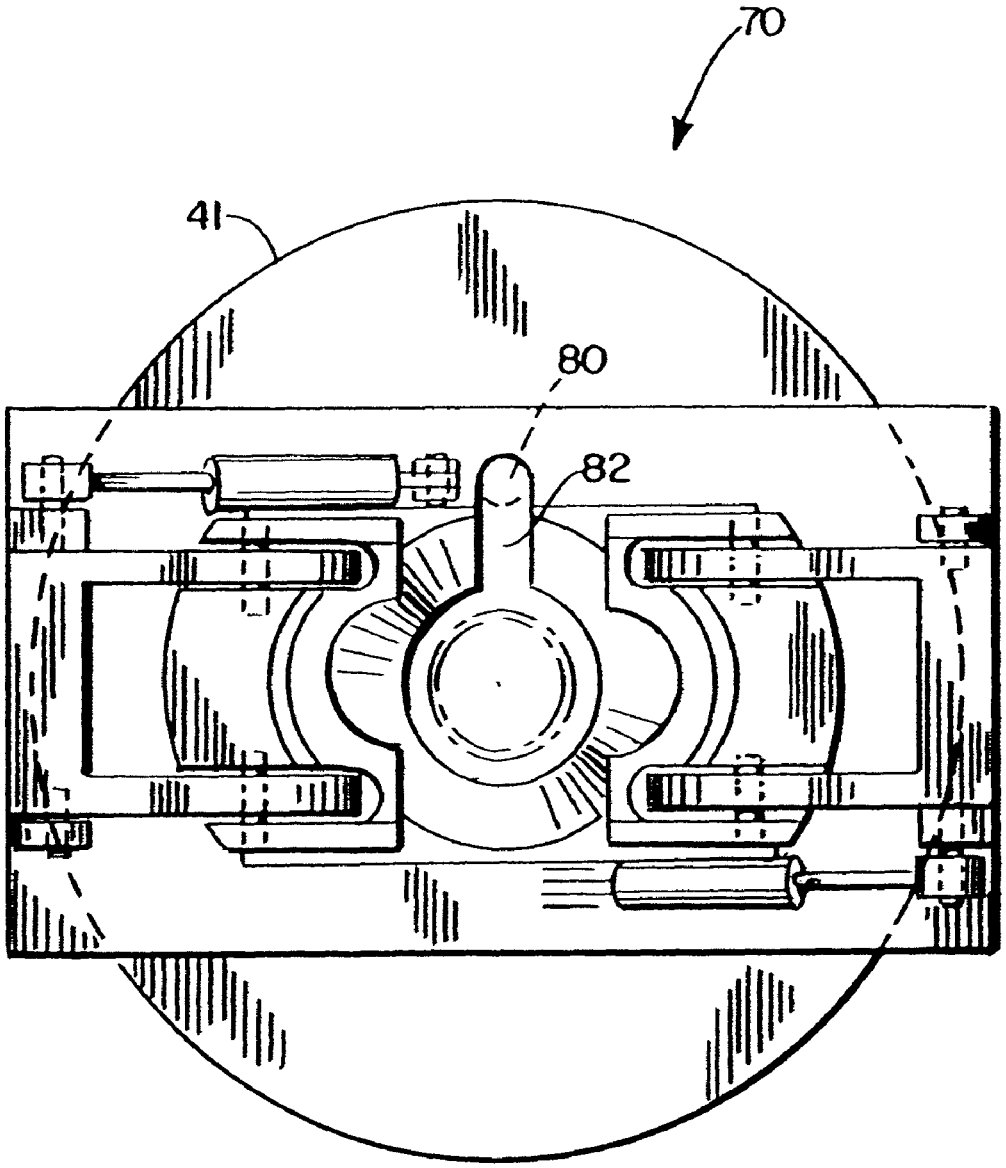
Figure 33:
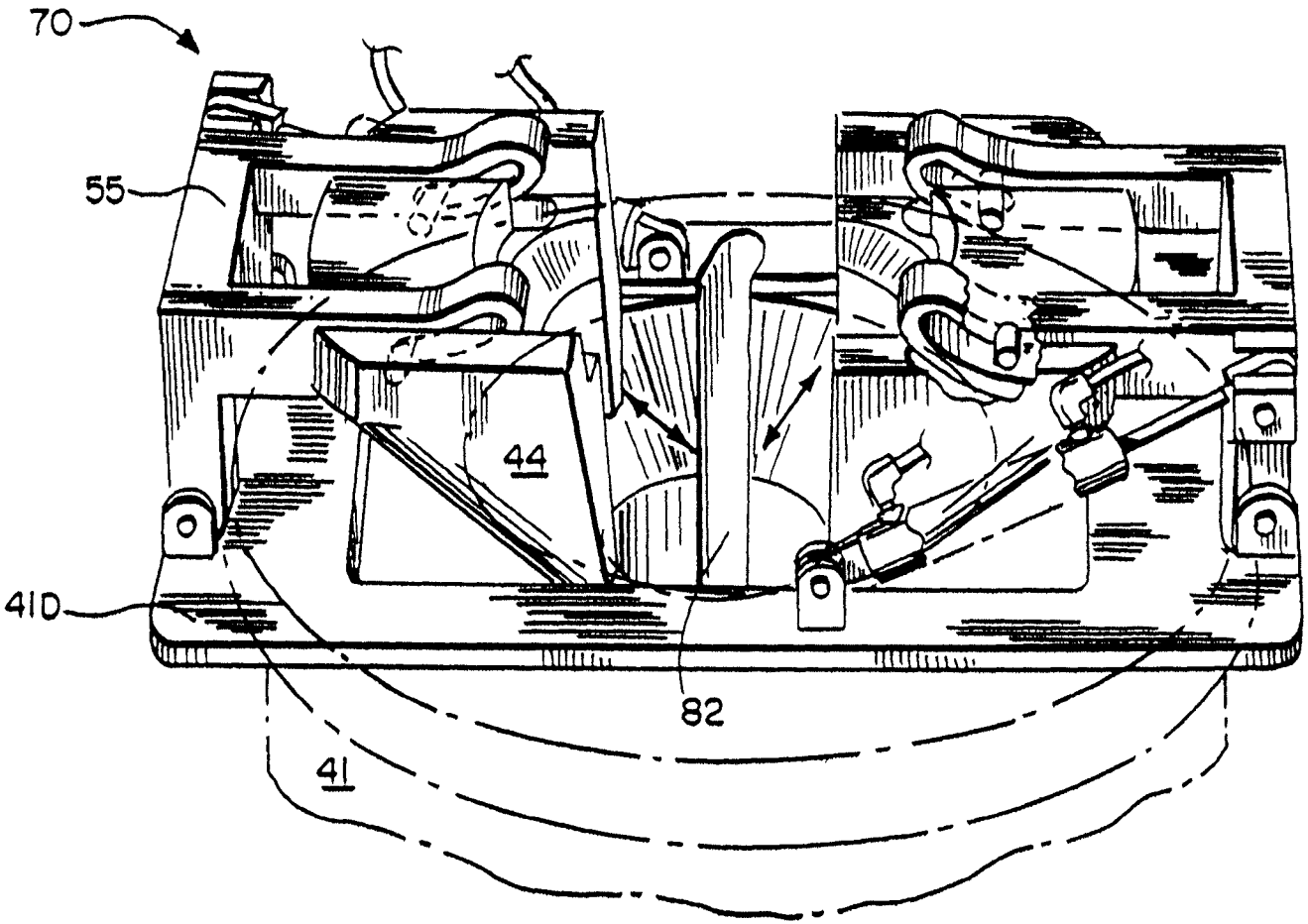
Figure 37:
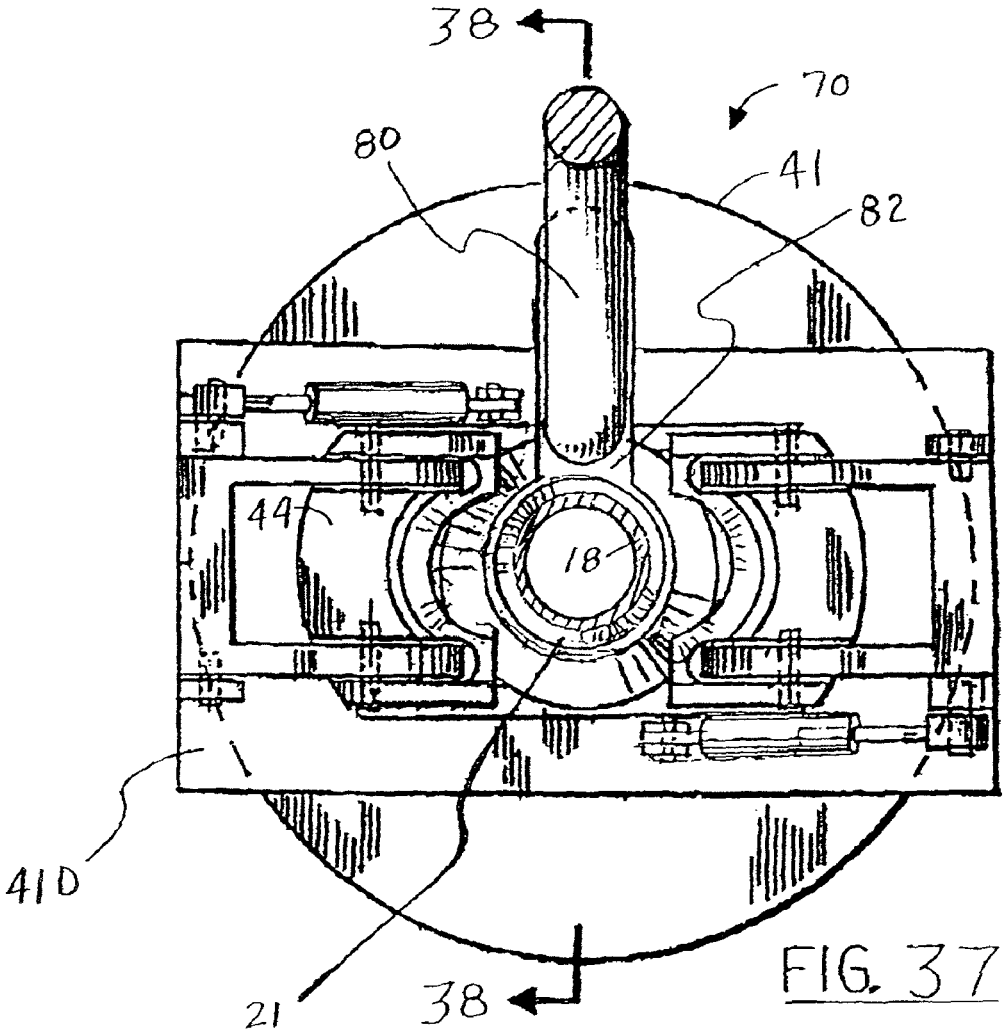
FIG. 37 is a plan view of a further embodiment of the apparatus of the present invention, showing a conduit and conduit groove of a larger size than that depicted in FIGS. 30 through 33.
Figure 38:
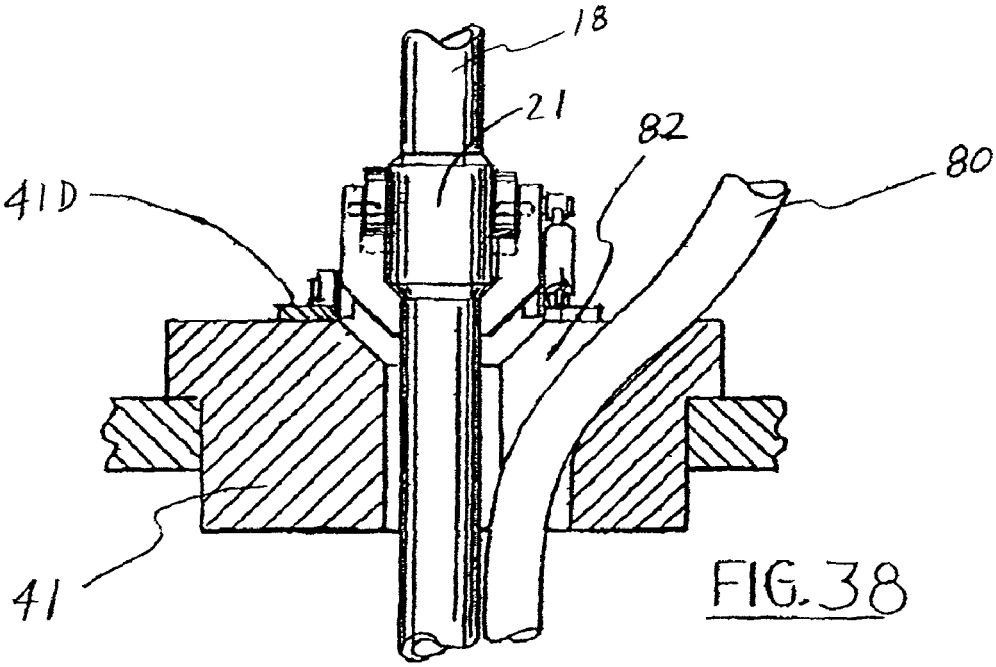
FIG. 38 is a cross sectional view taken along lines 38-38 of FIG. 37.
Figure 39:
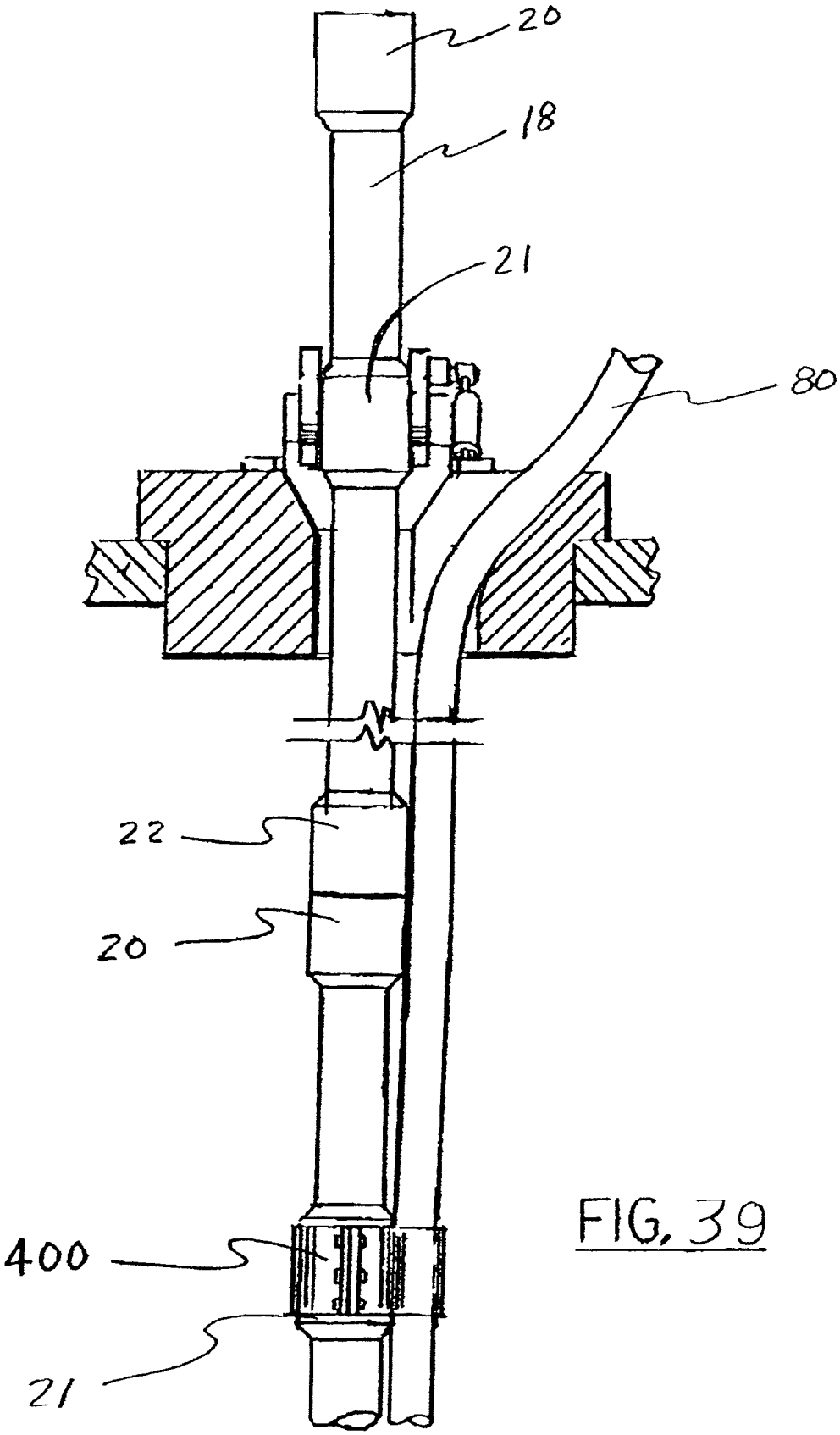
FIG. 39 is an elevational view of the embodiment shown in FIGS. 37 and 38 depicting the conduit clamped to an enlarged diameter section of the drill pipe.

Umbilical cord clearance groove 82 is preferably sized and positioned so as to permit umbilical cord 80 to pass safely therethrough, whether the wedge members 44 are in the disengaged position as shown in FIGS. 37 and 38 or in the engaged position as shown in FIG. 39, thereby protecting umbilical cord 80 from being crushed or otherwise damaged as it is lowered and raised with the landing string. The umbilical cord or conduit 80 and its accommodating clearance 82 as depicted in FIGS. 30-32 are relatively small as compared to those shown in FIGS. 37-39.

The umbilical cord may be affixed to drill pipe 18 at various intervals along its length, as for example by the clamping mechanism 400 shown in FIG. 39, which clamps conduit 80 to drill pipe 18 at enlarged diameter section 21. Umbilical cord 80 may be stored on a spool (not shown) located on or near the drilling rig floor 9, such that umbilical cord 80 is fed with and positioned next to the drill pipe 18 as the drill pipe is being lowered or raised through the drilling rig floor.

The shoulders of the wedge members of the present invention, such as shoulder 109 (FIG. 8) and shoulder 62 (FIG. 26), and the corresponding shoulders of the drill pipe, such as shoulders 20*a* and 21*a* (FIG. 2), are preferably surfaces which are each defined by rotating a line 360° about the central longitudinal axis of the drill pipe. Said corresponding shoulders are so configured that they are rotatable 360° with respect to each other, regardless of the distance between said corresponding shoulders.

For example, corresponding shoulders 109 and 21*a* are fully rotatable with respect to each other, even when closely positioned next to each other just prior to their engagement and loading. Accordingly, no specific radial alignment of the corresponding shoulders is necessary prior to or during their engagement. This feature is important because the radial orientation of the drill pipe vis-a-vis the holder can be extremely difficult to change, thereby making it advantageous for said corresponding shoulders to be functionally engageable regardless of their radial alignment.

It should be understood that drilling rig 8 includes a drill platform having floor 9 with a work area for the rig personnel who assist in the various operations described herein. Although FIG. 1 shows drilling rig 8 situated on a drill ship 10, it should be understood that the present invention may be used on drilling rigs situated on platforms that are permanently affixed to the sea floor, or on semi-submersible and other types of deep water rigs. Moreover, although the invention is particularly useful for rigs drilling in deep water, the invention may also be used with shallow-water rigs and with rigs drilling on land.

The following table lists the part numbers and part descriptions as used herein and in the drawings attached hereto:

LIST OF REFERENCE NUMERAL

The following is a list of parts of the various references numeral used in this application.

| REFERENCE NUMBER | DESCRIPTION |
|---|---|
| 5 | invention in general overview |
| 8 | drilling rig |
| 9 | drilling rig floor |
| 10 | drill ship |
| 11 | opening in drilling rig floor |
| 12 | surface of ocean |
| 14 | undersea well |
| 15 | blowout preventors |
| 16 | sea floor |
| 17 | riser |
| 18 | drill pipe |
| 18a | curved outer surface of drill pipe |
| 18S | shorter joint of drill pipe of alternative embodiment |
| 18L | longer joint of drill pipe of alternative embodiment |
| 19 | landing string |
| 20 | box (female) end of drill pipe |
| 20a | tapered shoulder of box end |
| 20b | curved outer surface of box end |
| 21 | enlarged diameter section of drill pipe |
| 21a | supporting shoulder of enlarged diameter section |
| 21b | curved outer surface of enlarged diameter section |
| 22 | pin (male) end of drill pipe |

-continued

| REFERENCE NUMBER | DESCRIPTION |
|---|---|
| 22a | tapered shoulder of pin end |
| 22b | curved outer surface of pin end |
| 23 | lumen of drill pipe 18 |
| 24 | borehole |
| 25 | extra tapered shoulder |
| 26 | earthen formation |
| 28 | wall of borehole |
| 32 | surface casing |
| 34 | intermediate casing |
| 35 | casing string |
| 36 | crossover connection |
| 40 | upper holder of preferred embodiment |
| 41 | main body of lower holder 70 |
| 41A | lower surface of main body 41 |
| 41B | upper surface of main body 41 |
| 41C | main body of upper holder 40 |
| 41D | mounting plate of main body 41 |
| 42 | cylindrically shaped bore of main body 41 |
| 42A | cylindrically shaped bore of main body 41C |
| 43 | tapered face of main body 41 of lower holder |
| 43-2 | second tapered face of main body 41 of lower holder |
| 43A | tapered face of main body 41C of upper holder |
| 44 | wedge member |
| 45 | tapered outer face of wedge member 44 |
| 45-2 | second tapered outer face of the preferred embodiment of wedge member 44 |
| 46 | padeye |
| 47 | pivot pin |
| 48 | arrow |
| 49 | socket in lifting arm 55 |
| 50 | hydraulic cylinder |
| 51 | pushrod |
| 52 | pivotal connection |
| 53 | padeye |
| 54 | pin |
| 55 | lifting arm |
| 56 | curved free-end portion of lifting arm 55 |
| 57 | curved slot in curved free end 56 |
| 58 | hydraulic flowline |
| 59 | pinned connection |
| 60 | arrow |
| 61 | recess in wedge member 44 |
| 62 | shoulder of wedge member 44 |
| 63 | pivotal connection |
| 64 | pin member of pinned connection 59 |
| 65 | socket of pinned connection 59 |
| 70 | lower holder of preferred embodiment |
| 80 | umbilical cord |
| 82 | umbilical cord clearance groove |
| 100 | lower holder |
| 103 | opening in main body 104 |
| 104 | main body of lower holder |
| 105 | tapered inner face of main body 104 |
| 106 | wedge members of lower holder |
| 106a | curved inner surface of wedge member 106 accommodating drill pipe |
| 106b | curved inner surface of wedge member 106 accommodating enlarged diameter section 21 |
| 107 | tapered outer face of wedge members 106 |
| 108 | hinges connecting wedge members |
| 109 | tapered shoulder of wedge members 106 |
| 111 | connectors between wedge members 106 and lifting arms 112 |
| 112 | lifting arms for lifting wedge members 106 |
| 114 | actuator for moving lifting arm 112 |
| 115 | lifting eye on wedge member 106 |
| 200 | upper holder |
| 203 | opening in main body of upper holder |
| 204 | main body of upper holder |
| 205 | tapered inner face of main body 204 |
| 206 | wedge members of upper holder |
| 206a | curved inner surface of wedge member 206 accommodating drill pipe |
| 206b | curved inner surface of wedge member 206 accommodating end of drill pipe |
| 207 | tapered outer face of wedge member 206 |

-continued

| REFERENCE NUMBER | DESCRIPTION |
|---|---|
| 209 | tapered shoulder of wedge member 206 |
| 210 | elevator links |
| 211 | connectors between wedge member 206 and lifting arms 212 |
| 212 | lifting arm for lifting wedge member 206 |
| 213 | lifting eyes |
| 214 | actuator for moving lifting arm 212 |
| 215 | lifting eye on wedge member 206 |
| 220 | recessed area of upper holder |
| 221 | eye of elevator link |
| 222 | elevator link retainer |
| 224 | release pin |
| 225 | hinge |
| 230 | lifting eyes to support auxiliary upper holder |
| 300 | auxiliary upper holder |
| 301 | connectors for auxiliary holder 300 |
| 304 | main body of holder 300 |
| 400 | clamping mechanism |

The following table lists and describes the dimensions used herein and in the drawings attached hereto:

DIMENSION LIST

| DIMENSION | DESCRIPTION |
|---|---|
| E.O.D. | end outside diameter of pin end and box end of drill pipe |
| E.W.T. | end wall thickness of pin end and box end of drill pipe |
| P.I.D. | pipe inside diameter |
| P.W.T. | pipe wall thickness |
| P.O.D. | pipe outside diameter |
| E.D.W.T. | enlarged diameter wall thickness |
| R.W.H. | reasonable working height of box end above rig floor |
| L | length of drill pipe |
| D | distance between supporting shoulders |
| A | angle of shoulder taper |
| LE | length of enlarged diameter section |
| T-1 | top thickness of the wedge member |
| T-2 | thickness of the wedge member at the shoulder |
| T-3 | bottom thickness of the wedge member |
| H-1 | height of the wedge member |
| H-2 | vertical height of the shoulder of the wedge member |
| H-3 | distance between the bottom of the wedge member and the bottom of the shoulder |
| A.T. | Angle of taper of the outer face of the wedge member |
| A.T.-2 | Angle of taper of the second tapered outer face of the wedge member in the preferred embodiment |
| H.H. | Height of upper holder |
| W-1 | width of upper holder |
| W-2 | width of top of opening of upper holder |
| W-3 | width of bottom of opening of upper holder |

The foregoing embodiments are presented by way of example only; the scope of the present invention is to be limited only by the following claims.

The invention claimed is:

1. A method of landing items at a well location, comprising the steps of:

a) positioning a drilling rig above a well location, the drilling rig having a landing string that is comprised of a number of joints of drill pipe, and a holder that holds a joint of drill pipe in the landing string for supporting the landing string;

b) attaching an item to the lower end of the landing string and lowering the landing string such that it spans the distance between the drilling rig and the well location;

c) wherein the holder, and the joint of drill pipe that is held by the holder, are configured to support the tensile load of the landing string with correspondingly shaped shoulders that engage when the holder holds the joint of drill pipe;

d) wherein the shoulder of a plurality of the joints of drill pipe have an angle of taper greater than about 45 degrees, wherein the shoulders are rotatable with respect to each other regardless of the distance between said shoulders.

2. The method of claim 1, wherein in step "d" the angle of taper is between about 47 and about 63 degrees.

3. The method of claim 1, wherein in step "d" the angle of taper is between about 49 and about 61 degrees.

4. The method of claim 1, wherein in step "d" the angle of taper is between about 51 and about 59 degrees.

5. The method of claim 1, wherein in step "d" the angle of taper is between about 53 and about 57 degrees.

6. The method of claim 1, wherein in step "d" the angle of taper is about 55 degrees.

7. A method of well casing placement comprising the steps of:

a) positioning a drilling rig above a well location, the drilling rig having a landing string that is comprised of a number of joints of drill pipe, and a holder that holds a joint of drill pipe in the landing string for supporting the landing string;

b) lowering a plurality of connected joints of casing to the well, said plurality of connected joints of casing defining a casing string, the casing string being supported by the landing string;

c) configuring the combination of landing string and casing string so that the overall combined length of the landing string and casing string spans the distance between the drilling rig and the well location;

d) wherein the holder, and the joint of drill pipe that is held by the holder, are configured to support the tensile load of step "c" with correspondingly shaped frustoconical shoulders that engage when the holder holds the joint of drill pipe, said shoulders having an angle of taper greater than about 45 degrees; and e) wherein the joint of drill pipe that is held by the holder includes a plurality of separate drill pipes that are mated together end to end.

8. The method of claim 7, wherein in step "d" the angle of taper is between about 47 and about 63 degrees.

9. The method of claim 7, wherein in step "d" the angle of taper is between about 49 and about 61 degrees.

10. The method of claim 7, wherein in step "d" the angle of taper is between about 51 and about 59 degrees.

11. The method of claim 7, wherein in step "d" the angle of taper is between about 53 and about 57 degrees.

12. The method of claim 7, wherein in step "d" the angle of taper is about 55 degrees.

13. A drilling rig, pipe and pipe handling apparatus, comprising:

a) a drilling rig with a floor;

b) a landing string comprised of a number of joints of pipe connected end to end at the floor, at least a plurality of the joints of pipe having an enlarged diameter section with a shoulder that is spaced apart from either end of the pipe;

c) first and second holders that provide support for the tensile loaded landing string;

d) wherein the first holder is a lower holder positioned near the rig floor that holds a joint of pipe of the landing string and supports the landing string during the addition or removal of a joint of pipe to or from the landing string, and the second holder is an upper holder that holds a joint of pipe in the landing string and supports the landing string after a joint of pipe has been added to or removed from the landing string;

e) each of the holders including a main body and a plurality of wedge members, the wedge members forming an interface between the body and the joint of pipe being held by the holder, each wedge member having a shoulder that corresponds in shape to and engages with the shoulder at the enlarged diameter section of the joint of pipe being held by one of the holders;

f) wherein the shoulders are rotatable with respect to each other, regardless of the distance between said shoulders; and g) wherein the joint of pipe being held by one of the holders includes separate pipes mated together end to end, the mated ends of said separate pipes forming the enlarged diameter section of the joint of pipe being held; and h) wherein the angle of taper of a plurality ofjoints of drill pipe is greater than about 45 degrees.

14. The method of claim 13, wherein in step "d" the angle of taper is between about 47 and about 63 degrees.

15. The method of claim 13, wherein in step "d" the angle of taper is between about 49 and about 61 degrees.

16. The method of claim 13, wherein in step "d" the angle of taper is between about 51 and about 59 degrees.

17. The method of claim 13, wherein in step "d" the angle of taper is between about 53 and about 57 degrees.

18. The method of claim 13, wherein in step "d" the angle of taper is about 55 degrees.

* * * * *